US007562972B2

(12) United States Patent
Hattori et al.

(10) Patent No.: US 7,562,972 B2
(45) **Date of Patent: *Jul. 21, 2009**

(54) INK CARTRIDGES HAVING SIGNAL BLOCKING PORTIONS

(75) Inventors: Shingo Hattori, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/863,147

(22) Filed: Sep. 27, 2007

(65) Prior Publication Data

US 2008/0180498 A1 Jul. 31, 2008

(30) Foreign Application Priority Data

Jan. 30, 2007 (JP) ..... 2007-018806
Mar. 20, 2007 (JP) ..... 2007-094759
Mar. 28, 2007 (JP) ..... 2007-083778

(51) Int. Cl.
*B41J 2/175* (2006.01)
*B41J 2/195* (2006.01)
*B41J 29/393* (2006.01)

(52) U.S. Cl. ..... 347/86; 347/7; 347/19

(58) Field of Classification Search ..... 347/86, 347/87, 19, 7

See application file for complete search history.

(56) References Cited

U.S. PATENT DOCUMENTS 3,864,705 A 2/1975 Winkler
3,950,771 A 4/1976 Winkler
3,987,469 A 10/1976 Winkler et al.
3,988,752 A 10/1976 Winkler et al.
4,253,103 A 2/1981 Heinzl et al.
5,479,968 A 1/1996 Sanchez et al.
5,701,995 A 12/1997 Higuma et al.

(Continued)

FOREIGN PATENT DOCUMENTS

EP 1772270 A2 4/2007

(Continued)

OTHER PUBLICATIONS

Translation of JP 02188245 A to Yokoi, Katsuyuki, translated completely by the McElroy Translation Company on Jan. 29, 2009.*

(Continued)

*Primary Examiner*—Matthew Luu
*Assistant Examiner*—Shelby Fidler
(74) *Attorney, Agent, or Firm*—Baker Botts L.L.P.

(57) ABSTRACT

An ink cartridge includes a first signal blocking portion, a second signal blocking portion, and a third signal blocking portion. The first signal blocking portion is configured to either prevent a first signal from passing therethrough or to alter a path of the first signal when the first signal blocking portion receives the first signal, the second signal blocking portion is configured to either prevent a second signal from passing therethrough or to alter a path of the second signal when the second signal blocking portion receives the second signal, and the third signal blocking portion is configured to either prevent the second signal from passing therethrough or to alter a path of the second signal when the third signal blocking portion receives the second signal.

16 Claims, 23 Drawing Sheets

U.S. PATENT DOCUMENTS

| | | | | |
|---|---|---|---|---|
| 5,842,800 | A * | 12/1998 | Bailey et al. | 347/19 |
| 6,053,597 | A * | 4/2000 | Hirota | 347/19 |
| 6,097,405 | A * | 8/2000 | Lo et al. | 347/86 |
| 6,142,602 | A * | 11/2000 | Tanaka | 347/86 |
| 6,257,710 | B1 | 7/2001 | Haigo | |
| 6,270,207 | B1 | 8/2001 | Sasaki | |
| 6,283,587 | B1 | 9/2001 | Umemura | |
| 6,312,084 | B1 * | 11/2001 | Ujita et al. | 347/19 |
| 6,382,785 | B2 | 5/2002 | Inada et al. | |
| 6,390,590 | B1 * | 5/2002 | Hansburg | 347/19 |
| 6,409,302 | B2 | 6/2002 | Altfather et al. | |
| 6,454,399 | B2 | 9/2002 | Ujita et al. | |
| 6,478,416 | B2 | 11/2002 | Ishinaga et al. | |
| 6,502,701 | B2 | 1/2003 | Shinada | |
| 6,554,381 | B2 * | 4/2003 | Locher et al. | 347/7 |
| 6,554,412 | B1 | 4/2003 | Seino et al. | |
| 6,676,237 | B2 | 1/2004 | Kobayashi et al. | |
| 6,739,689 | B2 * | 5/2004 | Choi | 347/19 |
| 6,786,583 | B2 | 9/2004 | Ota et al. | |
| 6,874,874 | B2 | 4/2005 | Sasaki | |
| 6,929,363 | B2 | 8/2005 | Sakai et al. | |
| 6,938,997 | B2 | 9/2005 | Toba et al. | |
| 7,083,272 | B2 | 8/2006 | Silverbrook | |
| 7,125,108 | B2 | 10/2006 | Toba et al. | |
| 7,178,911 | B2 | 2/2007 | Katayama et al. | |
| 7,188,939 | B1 | 3/2007 | Sasaki | |
| 7,220,068 | B2 | 5/2007 | Silverbrook | |
| 7,222,950 | B2 | 5/2007 | Hattori et al. | |
| 2001/0017640 | A1 | 8/2001 | Inada et al. | |
| 2002/0071014 | A1 * | 6/2002 | Matsumoto et al. | 347/87 |
| 2002/0154200 | A1 | 10/2002 | Miyazawa et al. | |
| 2005/0024454 | A1 | 2/2005 | Hayamizu et al. | |
| 2005/0068389 | A1 * | 3/2005 | Katayama et al. | 347/86 |
| 2005/0146579 | A1 | 7/2005 | Sasaki et al. | |
| 2005/0185034 | A1 * | 8/2005 | Anma et al. | 347/86 |
| 2005/0195225 | A1 | 9/2005 | Takagi et al. | |
| 2006/0092215 | A1 | 5/2006 | Brugue et al. | |
| 2006/0125888 | A1 | 6/2006 | Kanbe | |
| 2006/0203051 | A1 * | 9/2006 | Kanbe | 347/86 |
| 2007/0070146 | A1 | 3/2007 | Hattori et al. | |
| 2007/0229615 | A1 | 10/2007 | Hattori et al. | |

FOREIGN PATENT DOCUMENTS

| | | | |
|---|---|---|---|
| EP | 1792736 | A1 | 6/2007 |
| EP | 1839871 | A1 | 10/2007 |
| EP | 1839873 | A1 | 10/2007 |
| JP | 02188245 | A * | 7/1990 |
| JP | H05-301350 | A | 11/1993 |
| JP | H11-170560 | A | 6/1996 |
| JP | H11-192718 | A | 7/1996 |
| JP | H10-006526 | A | 1/1998 |
| JP | H10-157158 | A | 6/1998 |
| JP | H11-188889 | A | 7/1999 |
| JP | 2004114557 | A | 4/2004 |
| JP | 2005047242 | A | 2/2005 |

OTHER PUBLICATIONS

European Patent Office, European Search Reports for Related EP Application No. 08003712 and 08003699 both dated Jun. 16, 2008.

* cited by examiner

INK CARTRIDGES HAVING SIGNAL BLOCKING PORTIONS

CROSS-REFERENCE TO RELATED APPLICATION

The present invention claims priority from Japanese Patent Application No. JP-2007-018806, which was filed on Jan. 30, 2007, Japanese Patent Application No. JP-2007-083778, which was filed on Mar. 28, 2007, and Japanese Patent Application No. JP-2007-094759, which was filed on Mar. 30, 2007, the disclosures of which are incorporated herein by reference in their entirety.

BACKGROUND OF THE INVENTION

1. Field of the Invention

The present invention relates generally to ink cartridges. In particular, the present invention is related to ink cartridges which are configured to dispense ink when used in combination with a printer.

2. Description of Related Art

A known recording apparatus, such as an ink-jet recording apparatus, includes an ink-jet recording head and a mounting portion to which a known ink cartridge is mounted. When the known ink cartridge is mounted to the mounting portion, the known recording apparatus is configured to dispense ink from a plurality of nozzles to record an image on a sheet of paper.

Another known recording apparatus includes a carriage configured to receive another known ink cartridge. This known recording apparatus is configured to determine a type of the ink cartridge by sensing an intensity of light reflected by the ink cartridge. When the carriage and the ink cartridge move, the intensity of the reflected light is measured by a sensor of the recording apparatus, and based on the intensity, the type of the ink cartridge is determined.

Yet another known recording apparatus includes a mounting portion which is separate from a carriage, and this known recording apparatus is configured to determine the type of another known ink cartridge when the ink cartridge is mounted to the mounting portion. Specifically, when the ink cartridge is mounted to the mounting portion, the recording apparatus detects the presence or absence of a signal blocking portion of the ink cartridge, and the type of the ink cartridge is determined based on the presence or absence of the signal blocking portion. Nevertheless, in this known recording apparatus, the speed with which various users mount the ink cartridge to the mounting portion may vary from user to user, such that the recording apparatus may reach different determinations from user to user. For example, if the speed with which the user mounts the ink cartridge to the mounting portion is greater than a predetermined speed, or if the user begins to insert the ink cartridge into the mounting portion and then partially removes the ink cartridge before finally fully inserting the ink cartridge into the mounting portion, the sensor may detect inaccurate information.

A known ink cartridge is detachably mounted to a known recording apparatus. This known ink cartridge includes an ink chamber for storing ink, a wall, and an ink supply portion positioned at the wall. In operation, the ink supply portion supplies ink from an interior of the ink chamber to the known recording apparatus. This known ink cartridge also includes an air intake portion which is positioned at the wall and is configured to draw air into the ink chamber from the atmosphere.

Another known ink cartridge is configured to be mounted to an accommodating chamber of the known recording apparatus, and the accommodating chamber includes a door which is configured to be opened and closed. After this known ink cartridge is mounted to the accommodating chamber and the door is closed, the door is configured to latch on to the ink cartridge to remove the ink cartridge from the accommodating chamber when the door is opened by a user, which increases the ease with which the ink cartridge may be removed from the accommodating chamber.

Yet another known ink cartridge includes a cover which encloses a wall at which an ink supply portion and an air intake portion are positioned, which protects the ink supply portion and the air intake portion. In this known ink cartridge, before the ink cartridge is mounted to the recording apparatus, the cover first needs to be removed. Moreover, when the ink cartridge is removed from the recording apparatus with ink remaining therein, and the user intends to use the ink cartridge again in the future, the user generally will re-cover the ink cartridge using the cover. Nevertheless, if the user is not able to locate the cover, e.g., if the user misplaced the cover or discarded the cover after the user mounted the ink cartridge to the recording apparatus, the user will not be able to re-cover the ink cartridge. Consequently, the ink cartridge may become damaged if the ink supply portion or the air intake portion contact a surface, or the ink cartridge may drip ink onto a surface or the user.

SUMMARY OF THE INVENTION

Therefore, a need has arisen for ink cartridges which overcome these and other shortcomings of the related art. A technical advantage of the present invention is that the configuration of the ink cartridge allows a printer to accurately determine information associated with the ink cartridge independent of the speed with which the user mount the ink cartridge to the printer and regardless of whether the user begins to insert the ink cartridge into the printer and then partially removes the ink cartridge before finally fully inserting the ink cartridge into the printer. Another technical advantage of the present invention is that the ink cartridge may include a movable member which is movably attached to a case of the ink cartridge and is configured to protect the ink supply portion or the air intake portion, or both, whenever the ink cartridge is not mounted to the recording apparatus. Consequently, the ink supply portion or the air intake portion, or both, may not be damaged if the ink cartridge contacts a surface, and the ink supply portion may not drip ink onto a surface or a user of the ink cartridge. Yet another technical advantage of the present invention is that the movable member may allow the ink cartridge to readily be removed from the recording apparatus.

According to an embodiment of the present invention, an ink cartridge comprises a case comprising a front face and a rear face opposite the front face, in which the case has at least a portion of an ink chamber defined therein, and the ink chamber is configured to store ink. The ink cartridge also comprises an ink supply portion positioned at the front face of the case, in which the ink supply portion is configured to dispense ink from an interior of the ink chamber to an exterior of the ink chamber, and an air intake portion positioned at the case, in which the air intake portion is configured to draw air into the ink chamber. Moreover, the ink cartridge comprises a movable member configured to move between a first position and a second position relative to the case, and at least one resilient member having a first end which is coupled to the front face of the case and a second end which is coupled to the movable member. Specifically, the at least one resilient member is configured to expand and to contract to move the movable member relative to the case between the first position and the second position.

According to another embodiment of the present invention, an ink cartridge comprises a case comprising a front face and a rear face opposite the front face, in which the case has at least a portion of an ink chamber defined therein, and the ink chamber is configured to store ink. The ink cartridge also comprises an ink supply portion positioned at the front face of the case, in which the ink supply portion is configured to dispense ink from an interior of the ink chamber to an exterior of the ink chamber, and an air intake portion positioned at the case, in which the air intake portion is configured to draw air into the ink chamber. Moreover, the ink cartridge comprises a movable member configured to move between a first position and a second position relative to the case, and at least one resilient member having a first end which is coupled to the front face of the case and a second end which is coupled to the movable member. Specifically, the at least one resilient member is configured to expand and to contract to move the movable member relative to the case between the first position and the second position, and the at least one resilient member contacts the front face of the case at a predetermined position which is offset from each of the air intake portion and the ink supply portion.

According to yet another embodiment of the present invention, an ink cartridge comprises a case having at least a portion of an ink chamber defined therein, in which the ink chamber is configured to store ink. The ink cartridge also comprises an ink supply portion positioned at the case, in which the ink supply portion is configured to dispense ink from an interior of the ink chamber to an exterior of the ink chamber, and an air intake portion positioned at the case, in which the air intake portion is configured to draw air into the ink chamber. Moreover, the ink cartridge comprises a movable member configured to move between a first position and a second position relative to the case, and at least one resilient member having a first end which is coupled to the case and a second end which is coupled to the movable member Specifically, the at least one resilient member is configured to expand in an expansion direction and to contract in a contraction direction opposite the expansion direction to move the movable member relative to the case between the first position and the second position, and a shape of the case in the expansion and contraction directions is unaltered when the at least one resilient member expands and contracts. In addition, the entire moveable member is configured to substantially simultaneously move in a first direction relative to the case when the at least one resilient member expands, and the entire moveable member is configured to substantially simultaneously move in a second direction opposite the first direction when the at least one resilient member contracts.

According to yet another embodiment of the present invention, an ink cartridge comprises a first signal blocking portion, and a second signal blocking portion, in which a first plane intersects each of the first signal blocking portion and the second signal blocking portion. The ink cartridge also comprises a third signal blocking portion, in which a second plane intersects each of the second signal blocking portion and the third signal blocking portion, and the second plane is perpendicular to the first plane. Moreover, each of the first signal blocking portion, the second signal blocking portion, and the third signal blocking portion are configured to either prevent a signal from passing therethrough or to alter a path of the signal.

According to a further embodiment of the present invention, an ink cartridge comprises a first signal blocking portion, a second signal blocking portion, and a third signal blocking portion. The third signal blocking portion is configured to move with respect to each of the first signal blocking portion and the second signal blocking portion, and the first signal blocking portion and the second signal blocking portion are configured to move with respect to the third signal blocking portion.

According to yet a further embodiment of the present invention, an ink cartridge comprises a first signal blocking portion, a second signal blocking portion, and a third signal blocking portion. The first signal blocking portion is configured to either prevent a first signal from passing therethrough or to alter a path of the first signal when the first signal blocking portion receives the first signal, and the second signal blocking portion is configured to either prevent a second signal from passing therethrough or to alter a path of the second signal when the second signal blocking portion receives the second signal. Moreover, the third signal blocking portion is configured to either prevent the second signal from passing therethrough or to alter a path of the second signal when the third signal blocking portion receives the second signal.

According to still yet a further embodiment of the present invention, an ink cartridge comprises a first signal blocking portion configured to selectively prevent a first signal from passing therethrough or to alter a path of the first signal, and a second signal blocking portion configured to selectively prevent a second signal from passing therethrough or to alter a path of the second signal. Moreover, the second signal blocking portion has a thickness determinative of whether the second signal blocking portion blocks or alters the path of the second signal at a time that the first signal blocking portion initially blocks or alters the path of the first signal.

According to another embodiment of the present invention, a packaging arrangement comprises an ink cartridge and a packaging member configured to enclose the ink cartridge. The ink cartridge comprises a case comprising a front face and a rear face opposite the front face, in which the case has at least a portion of an ink chamber defined therein, and the ink chamber is configured to store ink. The ink cartridge also comprises an ink supply portion positioned at the front face of the case, in which the ink supply portion is configured to dispense ink from an interior of the ink chamber to an exterior of the ink chamber, and an air intake portion positioned at the case, in which the air intake portion is configured to draw air into the ink chamber. Moreover, the ink cartridge comprises a movable member configured to move between a first position and a second position relative to the case, and at least one resilient member having a first end which is coupled to the front face of the case and a second end which is coupled to the movable member. Specifically, the at least one resilient member is configured to expand and to contract to move the movable member relative to the case between the first position and the second position. Moreover, each of a pressure inside the ink chamber and a pressure inside the packaging member is less than a pressure outside the packaging member.

According to yet another embodiment of the present invention, a packaging arrangement comprises an ink cartridge and a packaging member which encloses the ink cartridge. The ink cartridge comprises a case having at least a portion of an ink chamber defined therein, in which the ink chamber is configured to store ink. The ink cartridge also comprises an ink supply portion positioned at the case, in which the ink supply portion is configured to dispense ink from an interior of the ink chamber to an exterior of the ink chamber, and an air intake portion positioned at the case, in which the air intake portion is configured to draw air into the ink chamber. Moreover, the ink cartridge comprises a movable member configured to move between a first position and a second position relative to the case, and at least one resilient member having a first end which is coupled to the case and a second end which is coupled to the movable member Specifically, the at least one resilient member is configured to expand in an expansion direction and to contract in a contraction direction opposite the expansion direction to move the movable member relative to the case between the first position and the second position, and a shape of the case in the expansion and contraction directions is unaltered when the at least one resilient member expands and contracts. In addition, the entire moveable member is configured to substantially simultaneously move in a first direction relative to the case when the at least one resilient member expands, and the entire moveable member is configured to substantially simultaneously move in a second direction opposite the first direction when the at least one resilient member contracts. Moreover, each of a pressure inside the ink chamber and a pressure inside the packaging member is less than a pressure outside the packaging member.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

FIGS. 2(*c*) and 2(*d*) are perspective views of an ink cartridge in which a movable member is in a second position and a first position, respectively, according to another embodiment of the present invention.

FIGS. 3(*c*) and 3(*d*) are side views of the ink cartridge of FIGS. 2(*c*) and 2(*d*), respectively.

FIGS. 17(*c*) and 17(*d*) are exemplary timing diagrams of a sensor signal outputted from the first optical sensor and the second optical sensor, respectively, of the recording apparatus when a second ink cartridge is mounted to the cartridge mounting portion.

DETAILED DESCRIPTION OF EMBODIMENTS

Figure 1:
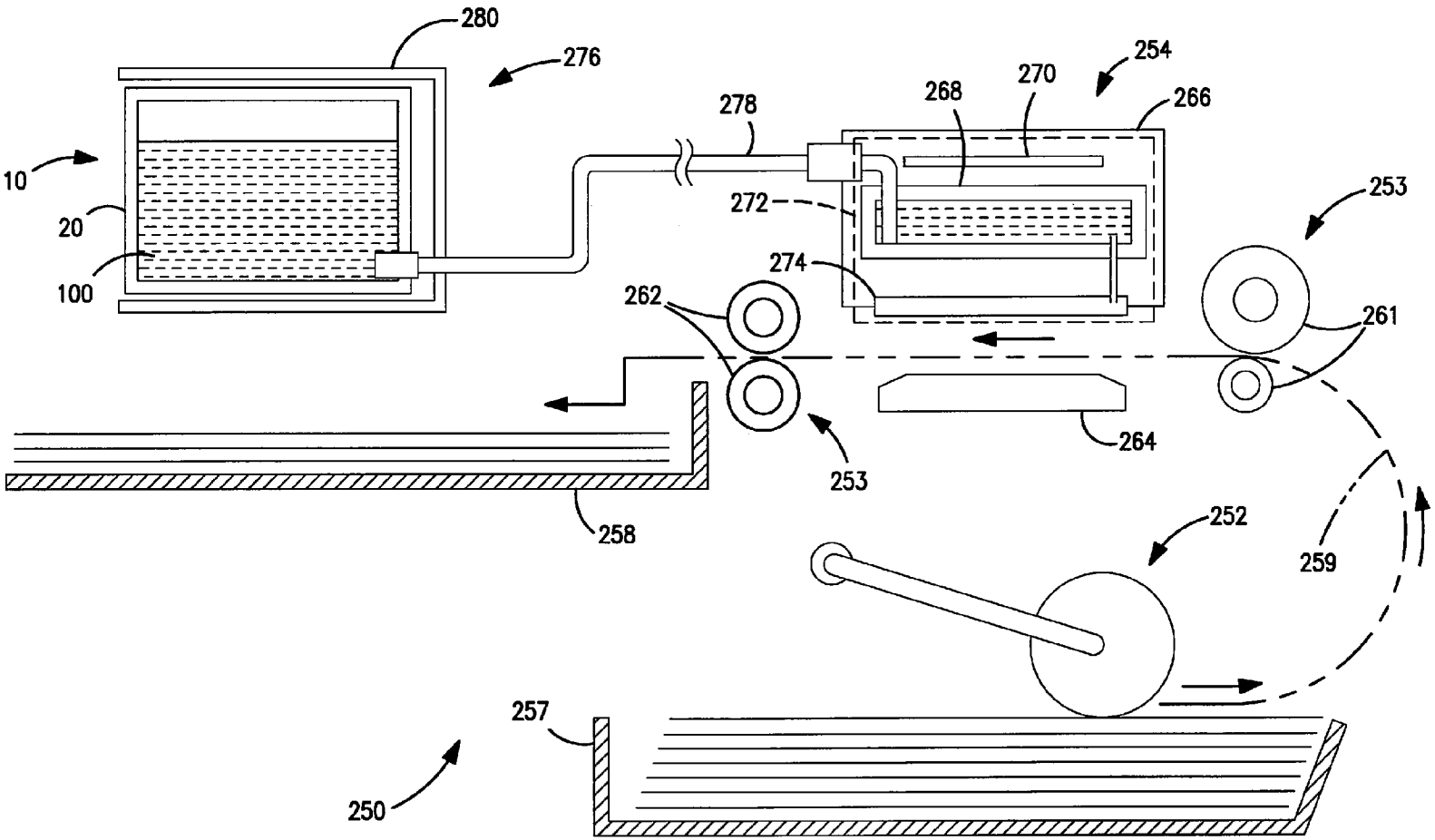
FIG. 1 is a cross-sectional, pattern diagram of a recording apparatus according to an embodiment of the present invention.
Figure 2B:
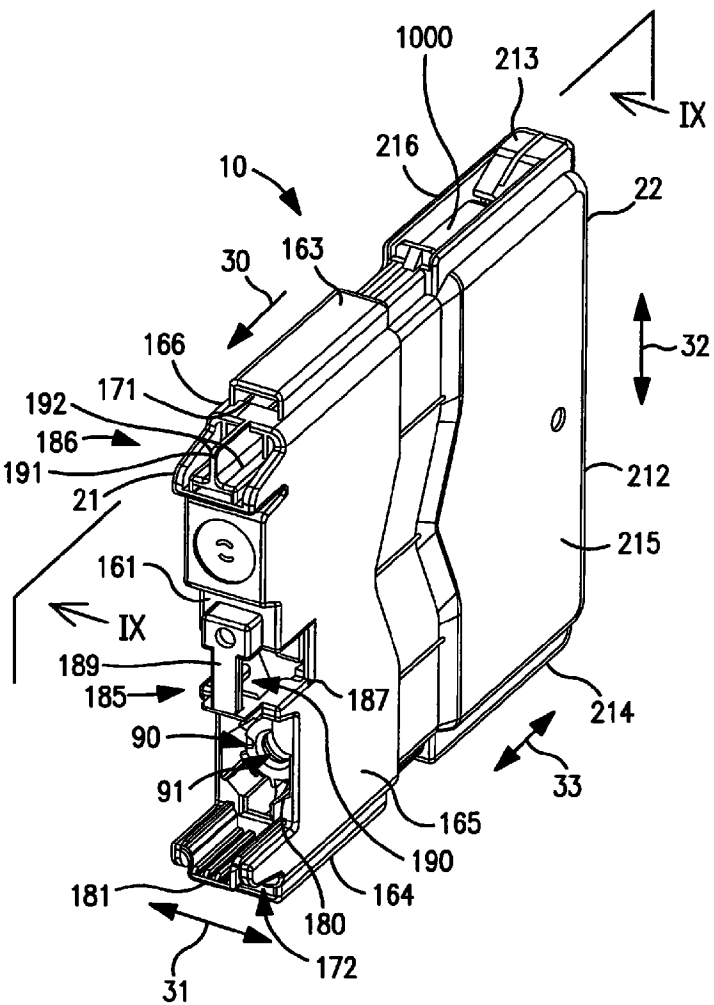
FIGS. 2(*a*) and 2(*b*) are perspective views of an ink cartridge in which a movable member is in a second position and a first position, respectively, according to an embodiment of the present invention.
Figure 2A:
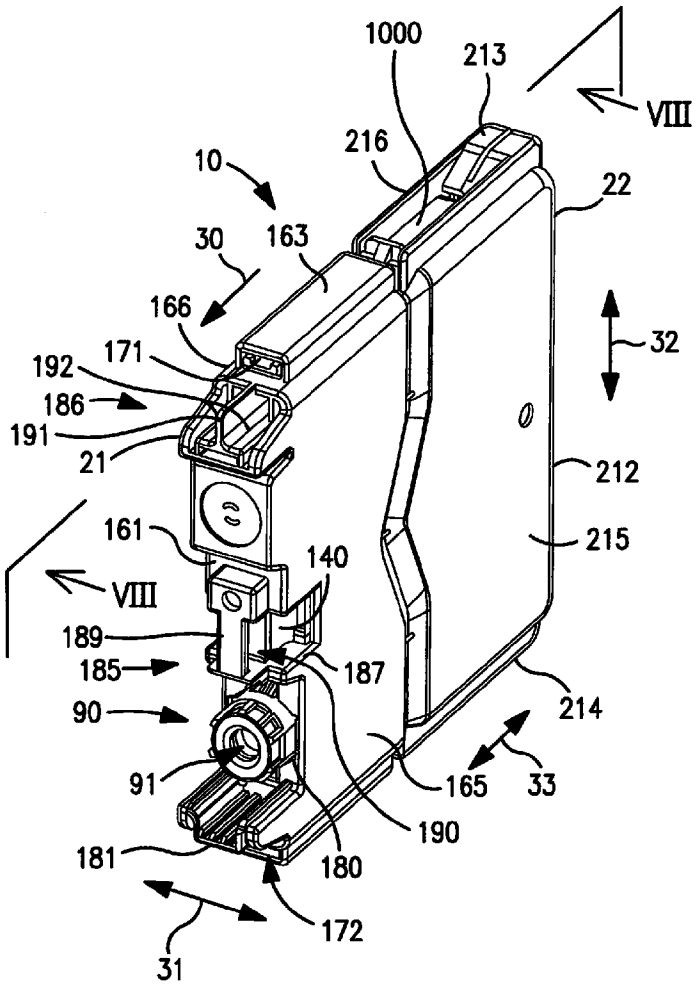
Figure 2D:
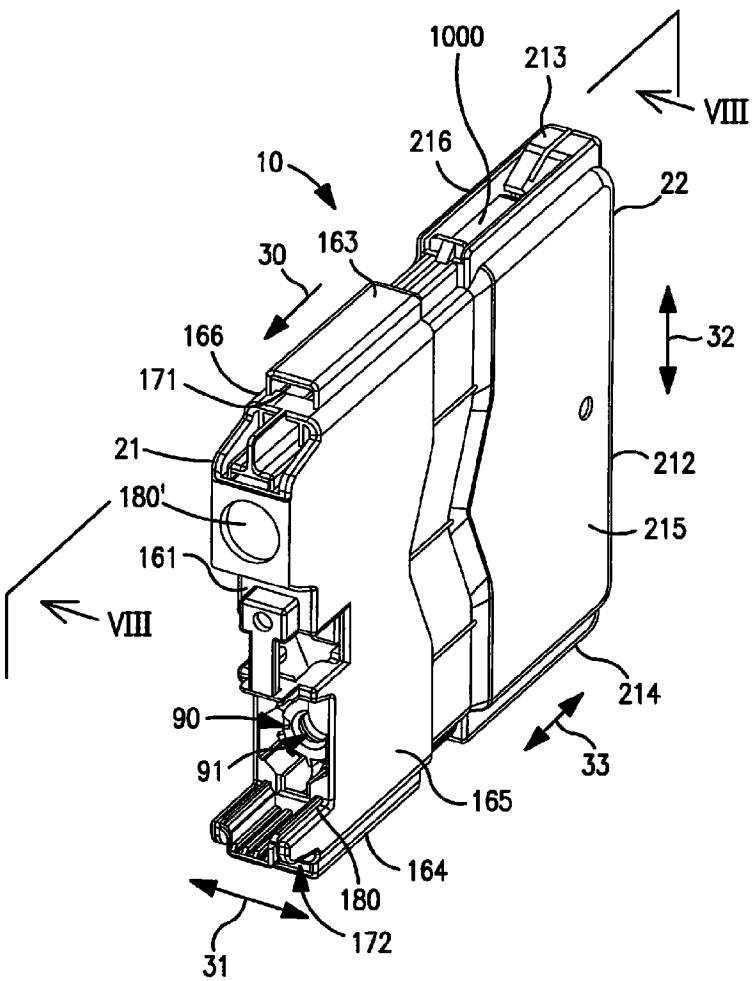
Figure 2C:
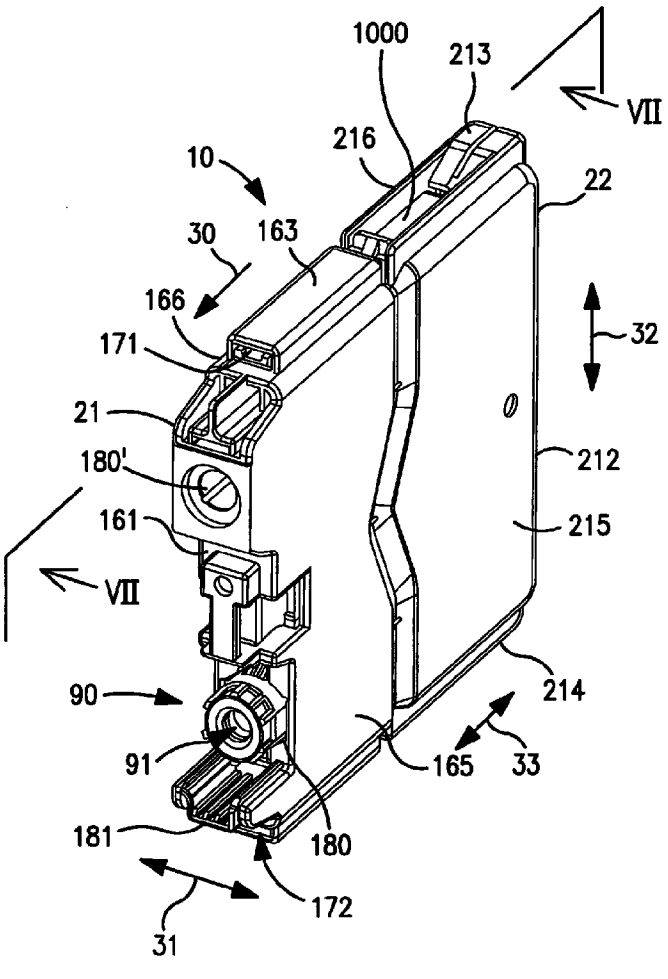
Figure 3A:
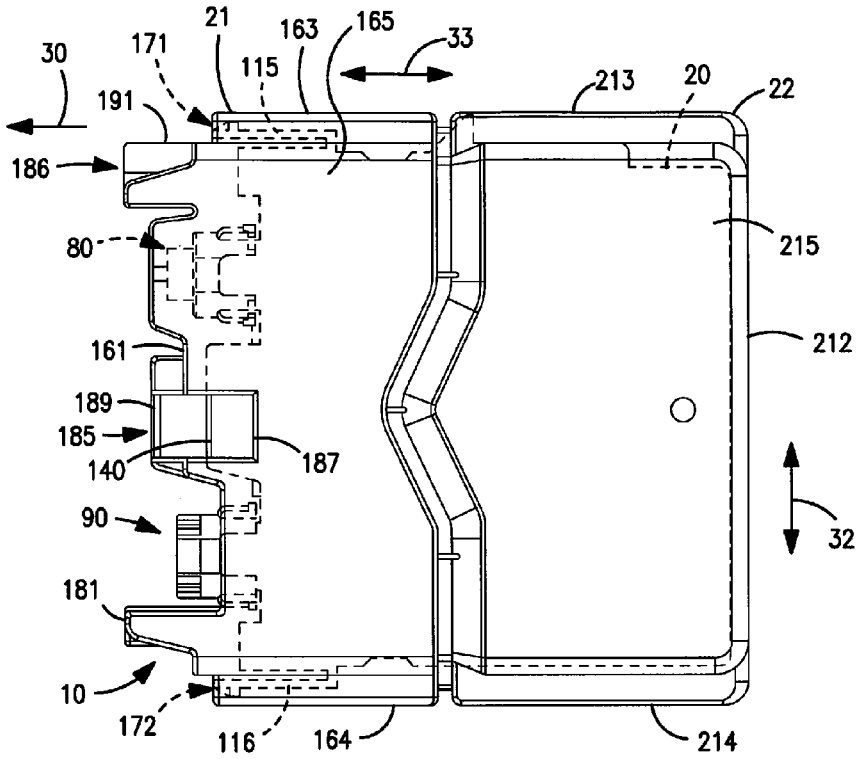
FIGS. 3(*a*) and 3(*b*) are side views of the ink cartridge of FIGS. 2(*a*) and 2(*b*), respectively.
Figure 3B:
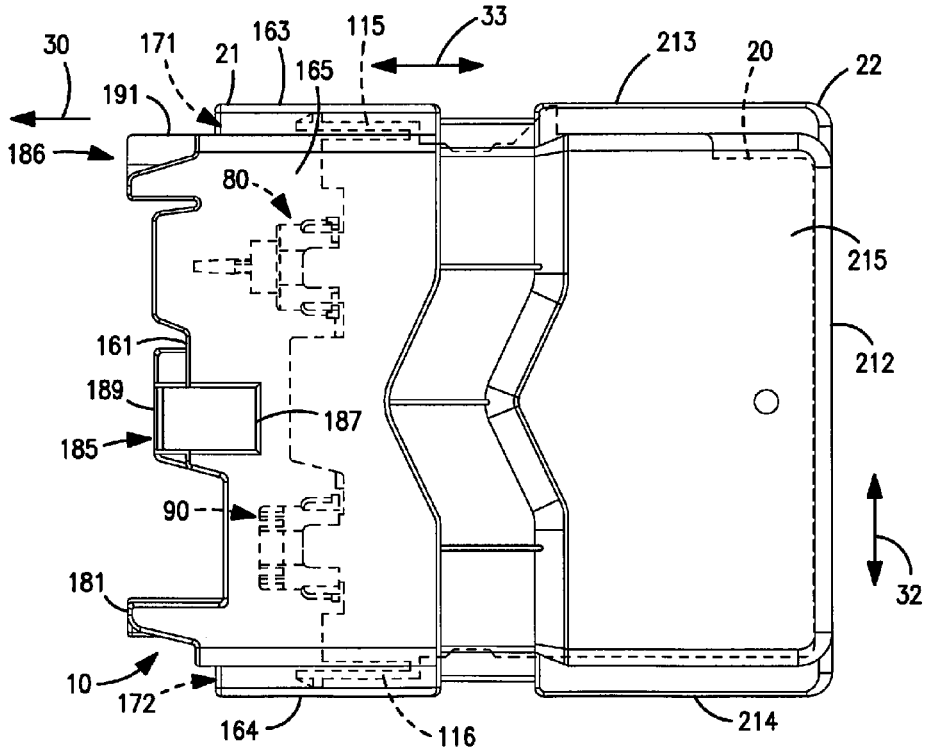
Figure 3C:
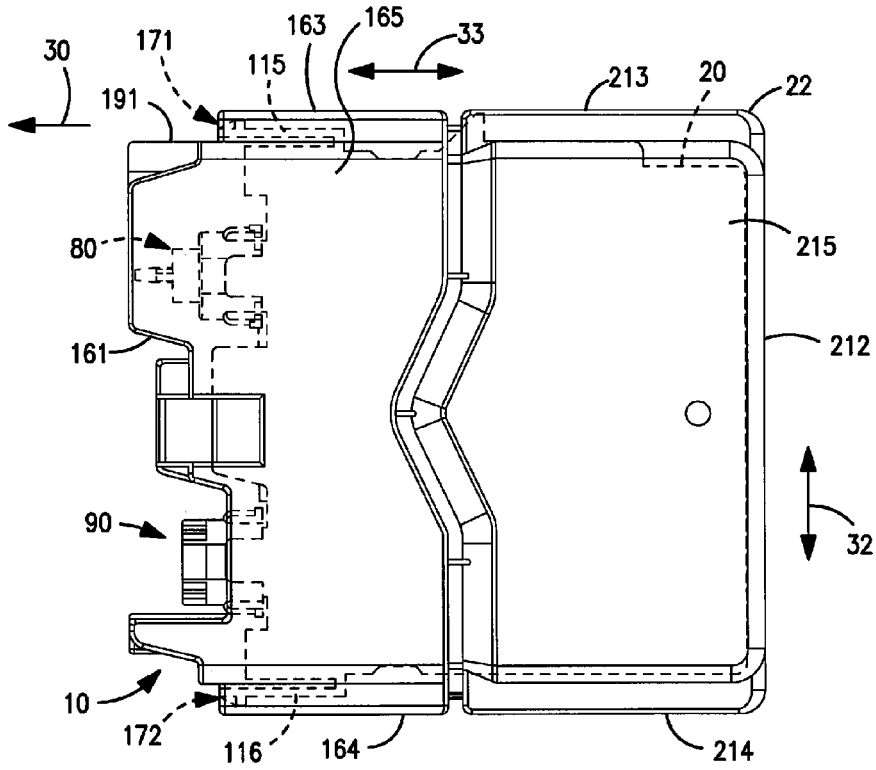
Figure 3D:
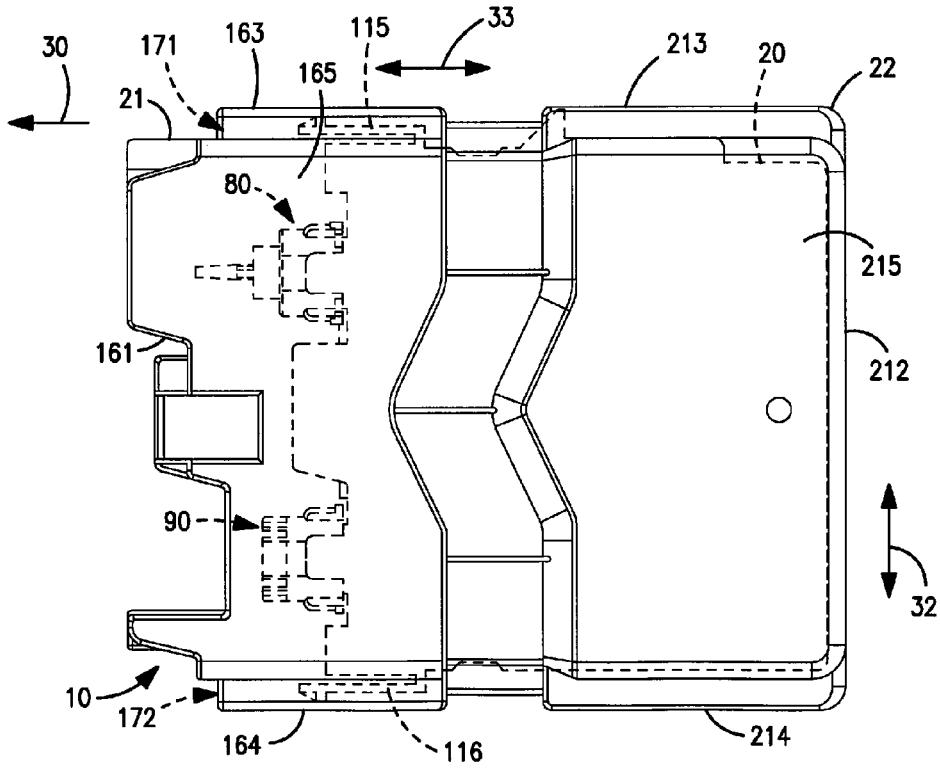

Embodiments of the present invention and their features and technical advantages may be understood by referring to FIGS. 1(*a*)-21, like numerals being used for like corresponding portions in the various drawings.

Referring to FIG. 1, a recording apparatus 250 according to an embodiment of the present invention is depicted. The recording apparatus 250 may comprise a paper feeding apparatus 252, a transferring apparatus 253, a recording unit 254, and a cartridge mounting portion 276. A paper feed tray 257 may be provided at the bottom of the recording apparatus 250, and sheets of paper positioned on the paper feed tray 257 may be fed, one by one, to a path 259 by the paper feeding apparatus 252.

The transferring apparatus 253 may be disposed in the path 259, and may comprise a first pair of transferring rollers 261 and a second pair of transferring rollers 262. The pair of transferring rollers 261 may be positioned on the upstream side of the recording unit 254 in a paper-transferring direction, and the pair of transferring rollers 262 may be positioned on the downstream side in the paper-transferring direction.

A sheet of paper fed to the path 259 may be transferred toward a platen 264 by the pair of transferring rollers 261, and the recording unit 254 may be positioned above the platen 264. An image may be recorded on the sheet of paper passing over the platen 264 by the recording unit 254, and the sheet of paper then may be discharged to a paper discharge tray 258 positioned on the downstream end of the path 259 by the pair of transferring rollers 262.

The recording unit 254 may comprise a carriage 266 and a recording head 272 mounted to the carriage 266. The recording head 272 may comprise a sub-tank 268 and a head control board 270, and may have a plurality of nozzles 274 formed therein. The carriage 266 may be slideably supported by a supporting rail, and may be configured to slide in the direction vertical to the paper plane of FIG. 1. The sub-tank 268 may be configured to store ink to be supplied to the nozzles 274. When image signals are supplied to the head control board 270, ink is discharged from the nozzles 274 toward the sheet of paper based on the image signals. The recording apparatus 250 may comprise a main controller 200 (shown in FIG. 16) for controlling the recording apparatus 250, and the image signals may be outputted from the main controller 200 and supplied to the head control board 270.

An ink cartridge 10 may be configured to be mounted to the cartridge mounting portion 276. The cartridge mounting portion 276 may comprise a plurality of cases 280, each of which is configured to receive a corresponding ink cartridge 10 therein. For example, the cartridge mounting portion 276 may comprise four cases 280, and each case 280 may correspond to an ink cartridge containing a different color of ink. The ink cartridge 10 may be configured to be mounted to and removed from the cartridge mounting portion 276. The ink cartridge 10 may comprise a main body 20, and the main body 20 may comprise an ink chamber 100 configured to store ink therein, and ink may be supplied from the ink chamber 100 to the recording head 272 via an ink tube 278.

In an embodiment of the present invention, two different ink cartridges may have different ink capacities or may store different amounts of ink, and may store the same color ink, e.g., black ink. For example, a first ink cartridge 10 and second ink cartridge 10' may have different ink capacities or may store different amounts of ink, and may store the same color ink. Moreover, the recording apparatus 250 may be configured, such that the ink cartridges 10 and 10' may be mounted to the same case 280 of the cartridge mounting portion 276. The recording apparatus 250 may be configured to determine which type of ink cartridge is mounted to the case 280.

Referring to FIGS. 2(*a*), 2(*b*), 3(*a*), 3(*b*), and 4-10(*b*), the ink cartridge 10 may have a substantially flat, hexahedron shape. A width of the ink cartridge, as indicated by an arrow 31, may be relatively short, and each of a height of the ink cartridge 10, as indicated by an arrow 32, and a depth of the ink cartridge 10, as indicated by an arrow 33, may be greater than the width of the ink cartridge 10.

The ink cartridge 10 may comprise a case, e.g., a main body 20, a movable member 21, a cover member 22, and at least one coil spring, e.g., a pair of coil springs 23 and 24. The main body 20 may comprise an ink chamber 100 for storing ink. The movable member 21 and the cover member 22 may enclose the main body 20 therein. Each of the main body 20, the movable member 21, and the cover member 22 may comprise a resin material, e.g. nylon, polyethylene, polypropylene, or the like, and combinations thereof.

The ink cartridge 10 is inserted into the recording apparatus in a direction indicated by an arrow 30 in an upright state. A front portion 20*a* of the main body may be enclosed by the movable member 21, and a rear portion 20*b* of the main body 20 may be enclosed by the cover member 22. Accordingly, in this embodiment of the present invention, the front portion 20*a* is protected by the movable member 21, and the rear portion 20*b* is protected by the cover member 22.

The movable member 21 is configured to slide in the depth direction, as indicated by the arrow 33, with respect to the main body 20. The movable member 21 is configured to move with respect to main body 20. Specifically, movable member 21 is configured to move between a first position, as shown in FIGS. 2(*b*) and 9, in which movable member 21 is at its furthest position from a front face 41 of the main body, and a second position, as shown in FIGS. 2(*a*) and 8, in which movable member 21 is at its closest position to the front face 41. When the movable member 21 is at the first position, at least a portion of the movable member 21 may be positioned further from the front face 41 than the ink supply portion 90 is positioned from the front face 41. In an embodiment, when a predetermined amount of force greater than the biasing force of the coil springs 23 and 24 is applied to the movable member 21, and thereby the movable member 21 moves from the first position to the second position, a rod 84 of an air intake portion 80 contacts the movable member 21 and is pressed by the movable member 21, and an ink supply portion 90 emerges from an inside of the movable member 21 to extend outside the movable member 21. When the predetermined amount of force is released from the movable member 21, and thereby the movable member 21 subsequently moves from the second position to the first position, the rod 84 separates from the movable member 21, and the ink supply portion 90 returns to the inside of the movable member 21. The entire moveable member 21 may be configured to substantially simultaneously move in a first direction relative to the main body 20 when the coil springs 23 and 24 expand, and the entire moveable member 21 may be configured to substantially simultaneously move in a second direction opposite the first direction when the coil springs 23 and 24 contract. Each of the first direction and the second direction may be substantially parallel to each of the expansion direction and the contraction direction of the coil springs 23 and 24. In another embodiment, discussed in detail below and shown in FIGS. 2(*c*), 2(*d*), 3(*c*), and 3(*d*), an opening 180' may be formed through a front wall 161 of the movable member 21 adjacent to and in alignment with the air intake portion 80, such that a component of the printer may apply the force to the rod 84 instead of the movable member 21 applying the force to the rod 84.

The main body 20 may have a substantially flat, hexahedron shape. When the ink cartridge 10 is mounted to the mounting portion of the recording apparatus, the main body 20 is in an upright state. The main body 20 may comprise the front face 41, a rear face 42, a top face 43, and a bottom face 44. The main body 20 also may comprise a pair of side faces 45 and 46 which oppose each other, and each of the side faces 45 and 46 may be connected to the front face 41, the rear face 42, the top face 43, and the bottom face 44. Each of side faces 45 and 46 may have a surface area which is greater than each of a surface area of the front face 41, the rear face 42, the top face 43, and the bottom face 44.

The main body 20 may comprise a frame 50, an arm 70, the air intake portion 80, and the ink supply portion 90. Moreover, the side face 45 or the side face 46, or both, may comprise a film, e.g., a translucent film. Specifically, the film may be welded to the frame 50, such that the frame 50 is sealed by the film to define an ink chamber 100 therein. The frame 50 may comprise a translucent or semi-transparent resin material e.g. polyacetal, nylon, polyethylene, or polypropylene, and combinations thereof, to allow light to pass therethrough, and the frame 50 may be formed by injection-molding. The frame 50 may be sufficiently rigid, such that the shape of the frame 50 may not be altered in the expansion and contraction directions of the coil springs 23 and 24 when the coil sprints 23 and 24 expand and contract.

The frame 50 may comprise an outer peripheral wall 51 and a plurality of inner walls 52. The inner walls 52 may be positioned within the outer peripheral wall 51. The outer peripheral wall 51 and the inner walls 52 may be integral and may define the frame 50. The outer peripheral wall 51 and the inner walls 52 may extend from the left side face 45 to the right side face 46 of the main body 20. The outer peripheral wall 51 may have an annular shape extending along the front face 41, the top face 43, the rear face 42, and the bottom face 44, and may form a space inside. Accordingly, an opening 57*a* may be formed on the left side face 45 of the frame 50, and an opening 57*b* may be formed on the right side face 46.

The films may be welded to the side faces 45 and 46 of the frame 50, respectively, via ultrasonic welding, and the opening 57*a* and the opening 57*b* may be covered by the respective films, such that a space surrounded by the outer peripheral wall 51 and the films may comprise the ink chamber 100. Alternatively, the films may be omitted, and the frame 50 may have a parallelepiped, container shape, such that the frame 50 defines the ink chamber 100 therein.

The inner walls 52 may be positioned within a space surrounded by the outer peripheral wall 51, and the films may be welded to the outer edge portions of the inner walls 52 on the sides of the side faces 45 and 46. Accordingly, the film may be prevented from sagging. Moreover, when the movable member 21 and the cover member 22 are deformed toward the main body 20, the deformation of the movable member 21 and the cover member 22 may be restricted by the inner walls 52. Accordingly, damage to the main body 20 and the films may be prevented.

An ink introduction port 150 may be formed in the rear face 42 of the frame 50. The ink introduction port 150 may have a substantially cylindrical hole formed therein, which extends from the rear face 42 toward the ink chamber 100, and the ink introduction port 150 may be in fluid communication with an interior of the ink chamber 100. The ink introduction port 150 may be configured to introduce ink into the interior of the ink chamber 100 therethrough when the ink cartridge 10 is manufactured. After the ink chamber 100 is filled with ink, the ink introduction port 150 may be closed by positioning a plug in the ink introduction port 150.

A translucent portion 140 may be positioned at the front face 41 of the frame 50 and may extend from the ink chamber 100. An amount of ink stored in the ink chamber may be optically or visually detected through the translucent portion 140. The translucent portion 140 may be integral with the frame 50, and may comprise the same material as the frame 50, e.g., the translucent portion 140 may comprise a translucent resin material to allow light to pass therethrough.

The translucent portion 140 may project outward from a center portion of the front face 41 of the main body 20 in a direction opposite from the ink chamber 100. The translucent portion 140 may be partitioned by five rectangular walls and may have a substantially a hollow box shape. For example, the translucent portion 140 may be partitioned by a front wall 140*a*, a pair of side walls 140*b*, top wall 140*c*, and bottom wall 140*d*. The front wall 140*a* may extend parallel to the front face 41 and may be separated from the front face 41 by a predetermined distance. The pair of side walls 140*b* may be connected to the front face 41 and the front wall 140*a*, the top wall 140*c* may be connected to top ends of the front wall 140*a* and the side walls 140*b*, and the bottom wall 140*d* may be connected to bottom ends of the front wall 140*a* and the side walls 140*b*. Moreover, the width of the front wall 140*a* may be less than the width of the front face 41.

The translucent portion 140 may be configured to be sandwiched between a light-emitting element (not shown) and a light-receiving element (not shown) of an optical sensor (not shown), e.g. photo interrupter, mounted to the recording apparatus. Light emitted by the light-emitting element may pass through the side walls 140*b* and may be received by the light-receiving element.

The translucent portion 140 may have an inner space 142 formed therein, which is defined by the front wall 140*a*, the side walls 140*b*, the top wall 140*c* and the bottom wall 140*d*. There is no wall positioned between the inner space 142 and the ink chamber 100, and the inner space 142 may be configured to be in fluid communication with the interior of the ink chamber 100. A signal blocking portion 72 of the arm 70 may be configured to selectively enter into and be removed from the inner space 142 based on an amount of ink within the ink chamber 100.

Figure 6:
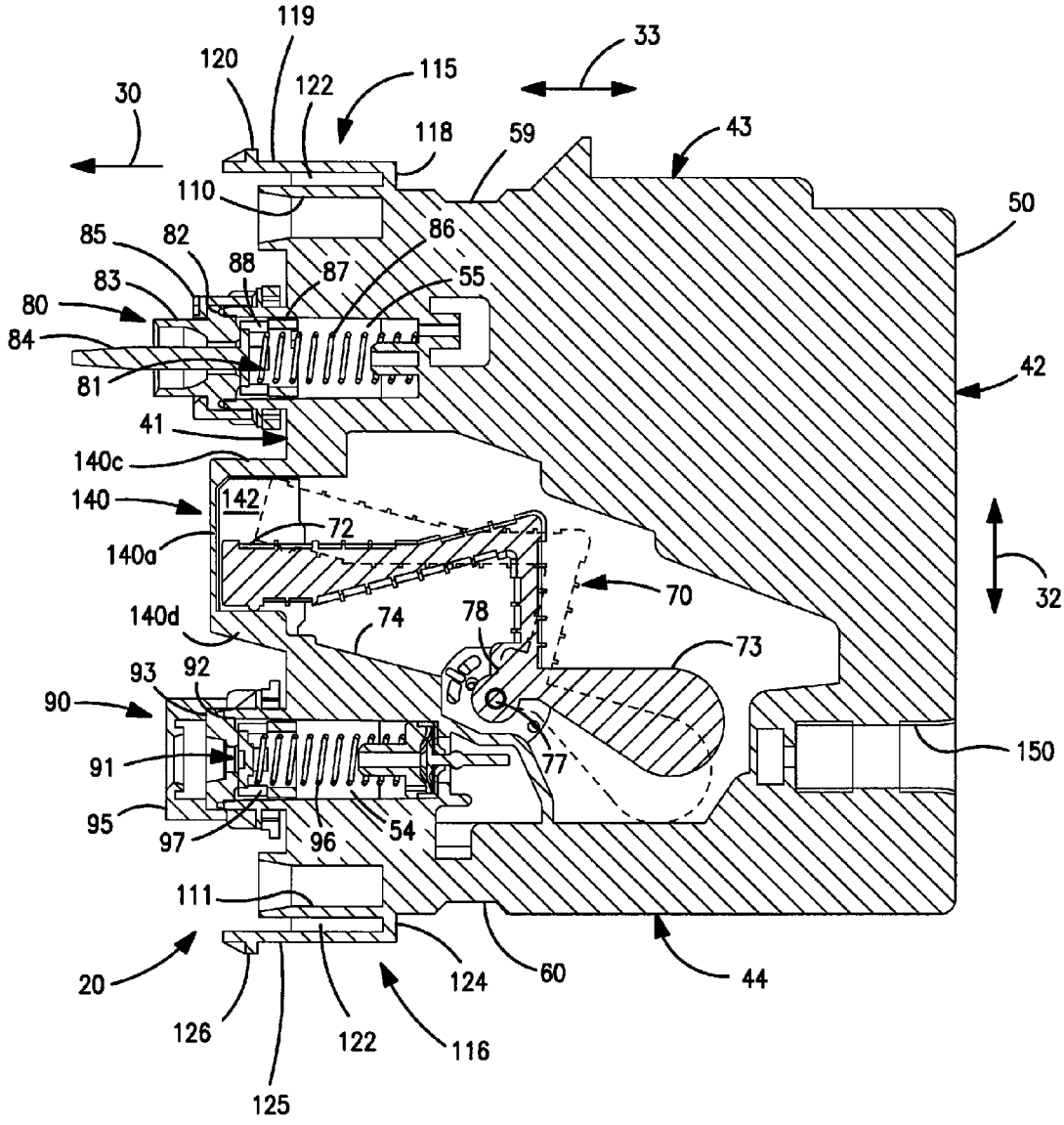
FIG. 6 is a cross-sectional view taken along the line VI-VI of FIG. 4(*a*).

The arm 70 may be used in detecting the amount of ink stored in the ink chamber 100. The arm 70 may comprise the signal blocking portion 72 at one end thereof, and a float portion 73 at the other end thereof. The arm 70 may be pivotably supported at a rib 74 extending upright from the widthwise center of the outer peripheral wall 51. The specific gravity of the float portion 73 may be less than the specific gravity of ink stored in the ink chamber 100. The float portion 73 may have a hollow formed therein, and may float on any liquid, such that the float portion 73 moves upward and downward based on the amount of ink within the ink chamber 100, and the arm 70 pivots based on the movement of the float portion 73. The rib 74 may be positioned at the outer peripheral wall 51 adjacent to a corner of the front face 41 and the bottom face 44. Referring to FIG. 6, the rib 74 may comprise a supporting portion 77 configured to pivotably support the arm 70.

Figure 4B:
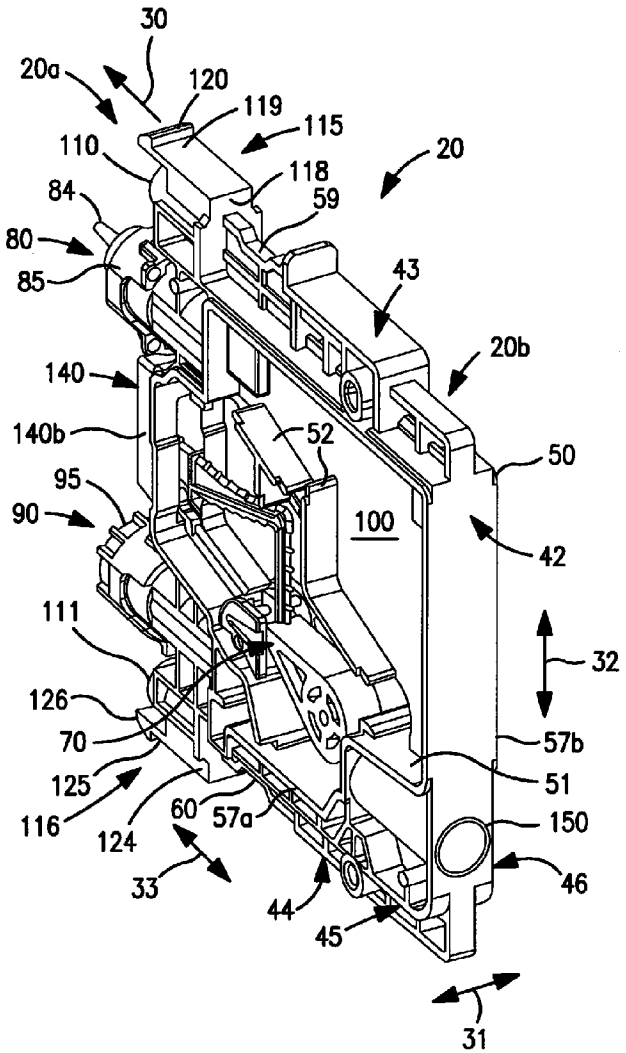
FIGS. 4(*a*) and 4(*b*) are a front-face perspective view and a rear-face perspective view of a main body of the ink cartridge of FIGS. 2(*a*) and 2(*b*).
Figure 4A:
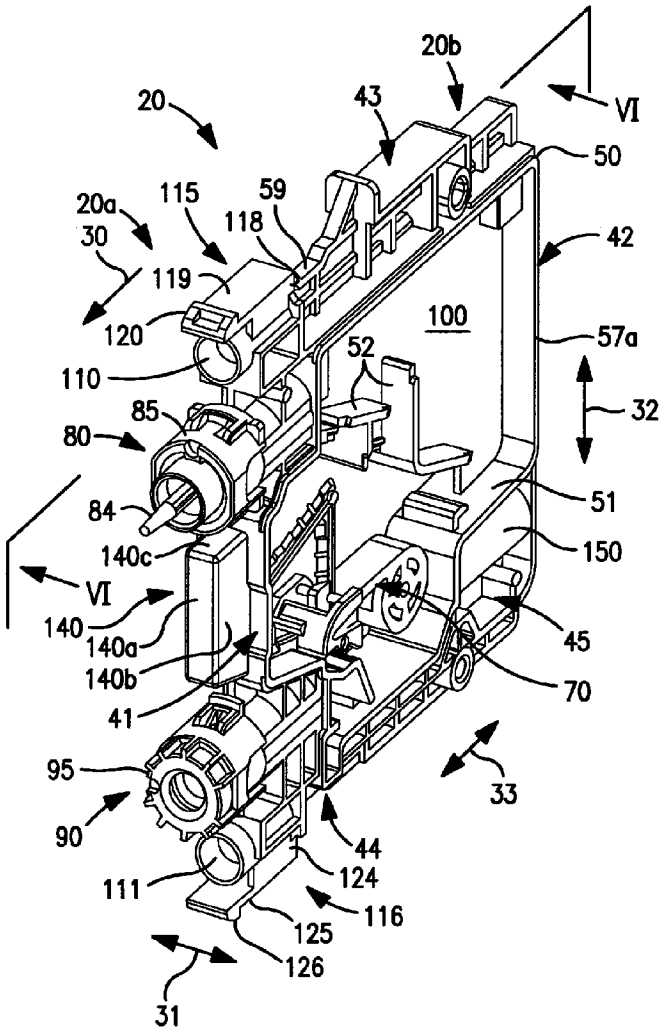
Figure 5:
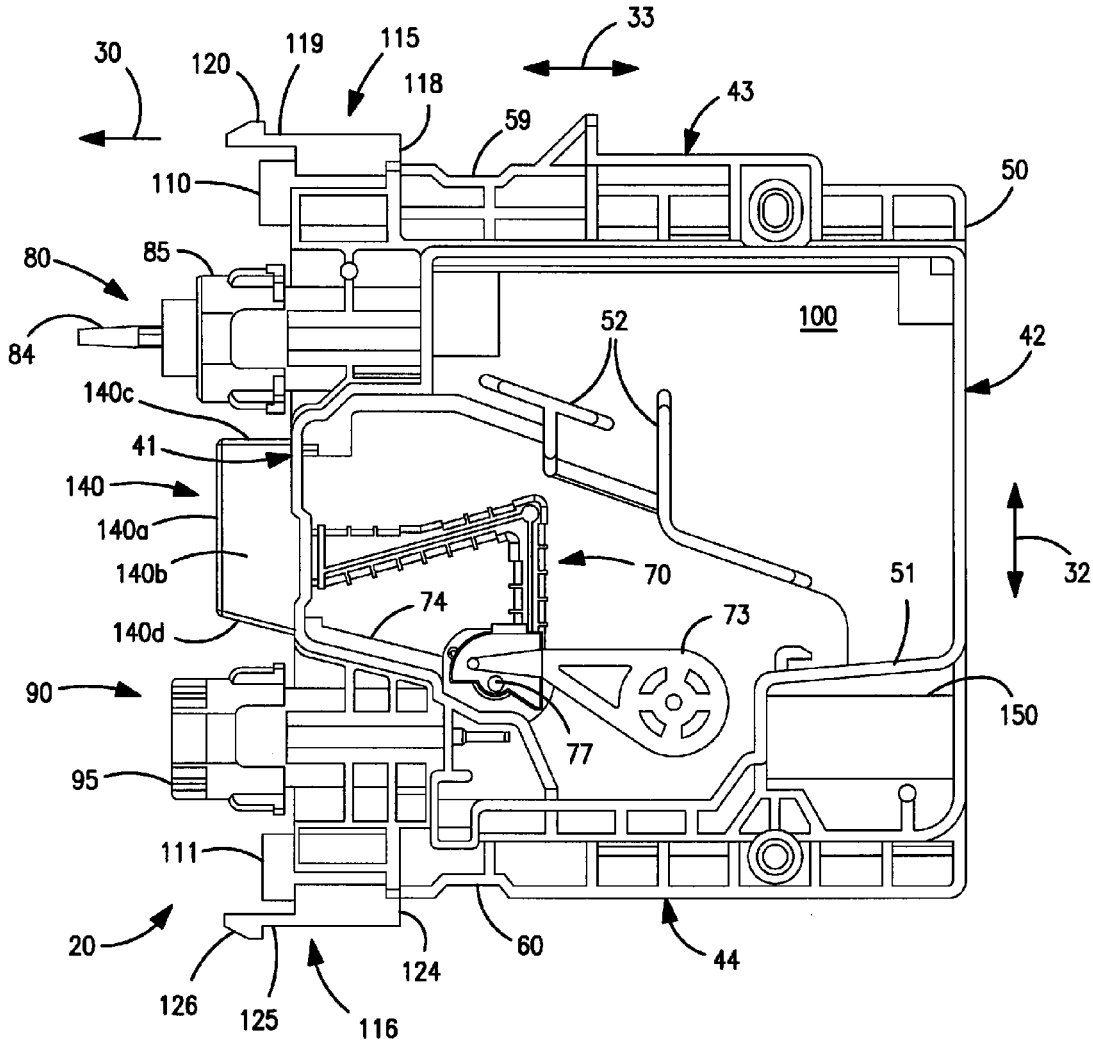
FIG. 5 is a side view of the main body of FIGS. 4(*a*) and 4(*b*).

Referring to FIGS. 4(*a*)-6, the arm 70 may be positioned, such that the signal blocking portion 72 is positioned in the inner space 142 when a sufficient amount of ink is stored in the ink chamber 100. For example, the signal blocking portion 72 may contact the bottom wall 140*d* of the translucent portion 140 to maintain the signal blocking portion 72 within the inner space 142 of the translucent portion. Moreover, when the amount of ink in the ink chamber 100 is less than a predetermined amount of ink, the float portion 73 moves downward, and the signal blocking portion 72 moves out of the inner space 142. Consequently, whether a sufficient amount of ink remains in the ink chamber 100 may be detected by monitoring whether the signal blocking portion 72 is positioned within the inner space 142. For example, an optical sensor, such as a photo interrupter, may be used to monitor whether the signal blocking portion 72 is positioned within the inner space.

Figure 7:
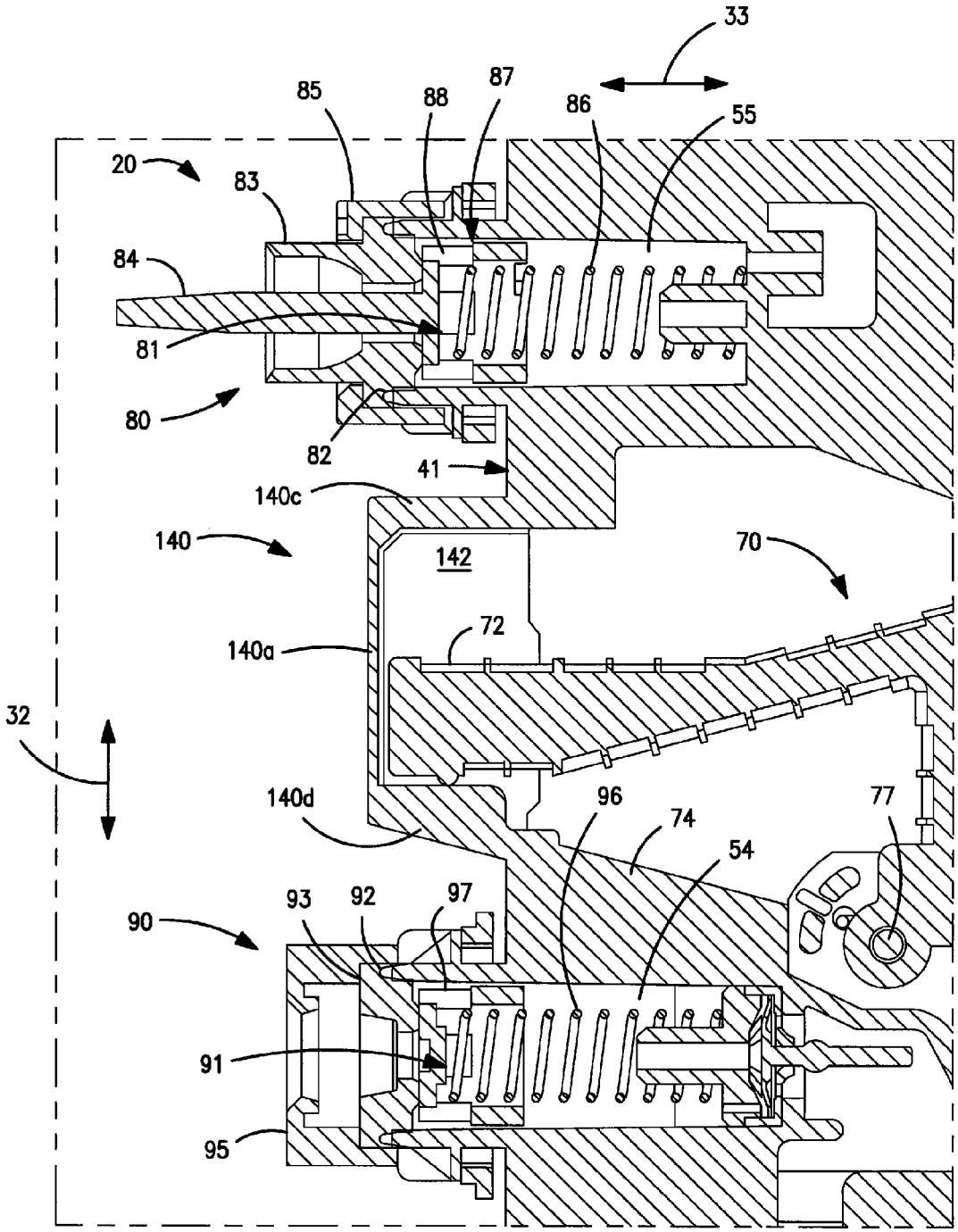
FIG. 7 is a partial, enlarged front-face cross-sectional view of the body of FIGS. 4(*a*) and 4(*b*).

Referring to FIG. 7, the air intake portion 80 may comprise a cylindrical valve storage chamber 55 formed in the front face 41 above the translucent portion 140. The valve storage chamber 55 may be open to the outside of main body 20 at an end 82 thereof. The valve storage chamber 55 extends in the depth direction of the main body 20, and is in fluid communication with the interior of the ink chamber 100 at the other end thereof.

The air intake portion 80 also may comprise a valve mechanism for selectively opening and closing a path extending from the end 82 of the valve storage chamber 55 to the interior of the ink chamber 100. For example, the air intake portion 80 may comprise a valve element 87, a spring 86, a sealing member 83, and a cap 85. The valve element 87 may be configured to slide in the depth direction of the main body 20 in the valve storage chamber 55. The valve element 87 may comprise a lid 88 and the rod 84. The cap 85 may be attached to the outer edge of the end 82 of the valve storage chamber 55, sandwiching the sealing member 83 therebetween. The cap 85 and the sealing member 83 may have through holes formed therethrough. When the cap 85 and the sealing member 83 are attached to the outer edge of the end 82, an air communicating port 81 may be formed by the through holes, and an inside and an outside of the valve storage chamber 55 may be in fluid communication via air communicating port 81. The rod 84 may be inserted into the air communicating port 81, and the diameter of the rod 84 may be less than the diameter of the air communicating port 81, such that a gap for allowing air flow is formed between the rod 84 and the interior walls of the air communicating port 81. The rod 84 may project outward from the center of the lid 88 through the air communicating port 81.

When the valve element 87 slides in the valve storage chamber 55, the lid 88 may slide between a position in which the lid 88 contacts the sealing member 83 and a position in which the lid 88 is separated from the sealing member 83. When the lid 88 contacts the sealing member 83, the air communicating port 81 is closed, and when the lid 88 separates from the sealing member 83, the air communicating port 81 is opened.

In the valve storage chamber 55, the spring 86 urges or biases the valve element 87 in the direction to close the path extending from the inside of the valve storage chamber 55 to the outside of the valve storage chamber 55, thereby causing the lid member 88 to contact the sealing member 83. When the rod 84 is pressed toward the valve storage chamber 55, the lid 88 of the valve element 87 separates from the sealing member 83 against urging force of the spring 86. Accordingly, the path extending from the inside of the valve storage chamber 55 to the outside of the valve storage chamber 55 is opened, and the communication between the interior of the ink chamber 100 and the outside of the main body 20 via the air intake portion 80 is established. With air flowing in and out of the ink chamber 100 via the air intake portion 80, the pressure of the interior of the ink chamber 100 is equalized as the ambient pressure.

Referring to FIG. 7, the ink supply portion 90 may comprise a cylindrical valve storage chamber 54 formed in the front face 41 below the translucent portion 140, and the valve storage chamber 54 may be open to the outside of the main body at an end 92 thereof. The valve storage chamber 54 may extend in the depth direction of the main body 20, and may be in fluid communication with the interior of the ink chamber 100 at the other end thereof.

The ink supply portion 90 also may comprise a valve mechanism for selectively opening and closing an ink path extending from the end 92 of the valve storage chamber 54 to the interior of the ink chamber 100. The ink supply portion 90 comprises a valve element 97, a spring 96, a sealing member 93, and a cap 95.

The cap 95 may be attached to the outer edge of the end 92 of the valve storage chamber 54, sandwiching the sealing member 93 therebetween. The cap 95 and the sealing member 93 may have through holes formed therethrough. When the cap 95 and the sealing member 93 are attached to the outer edge of the end 92 of the valve storage chamber 54, an ink supply port 91 may be formed by the through holes, and the ink supply port 91 may communicate an inside and an outside of the valve storage chamber 54. A tube may be inserted into the ink supply port 91 when the ink cartridge 10 is mounted to the cartridge mounting portion 276 shown in FIG. 12.

In the valve storage chamber 54, the spring 96 urges or biases the valve element 97 in the direction to close the ink path, such that the valve element 97 contacts the sealing member 93 and communication between the interior of the ink chamber 100 and the outside of the main body 20 is prevented. When the tube is inserted into the ink supply port 91, the tube pushes the valve element 97, and the valve element 97 separates from the sealing member 93 against the urging force of the spring 96, and the ink supply port 91 is opened. Accordingly, the communication between the interior of the ink chamber 100 and the outside of the main body 20 via the ink supply portion 90 is established, and the ink in the ink chamber 100 may be supplied through the tube to the recording apparatus 250.

A recessed portion 59 may be formed in the top face 43 of the frame 50, and a recessed portion 60 may be formed in the bottom face 44 of the frame 50. The recessed portions 59 and 60 may engage with projecting strips 210 and 211 (shown in FIG. 8), respectively, formed on the inner surface of the cover member 22 when the rear portion 20*b* of the main body 20 is covered by the cover member 22. The projecting strip 210 may be fitted to the recessed portion 59, and the projecting strip 211 may be fitted to the recessed portion 60, to provide secure engagement between the rear portion 20*b* and the cover member 22.

Figure 8:
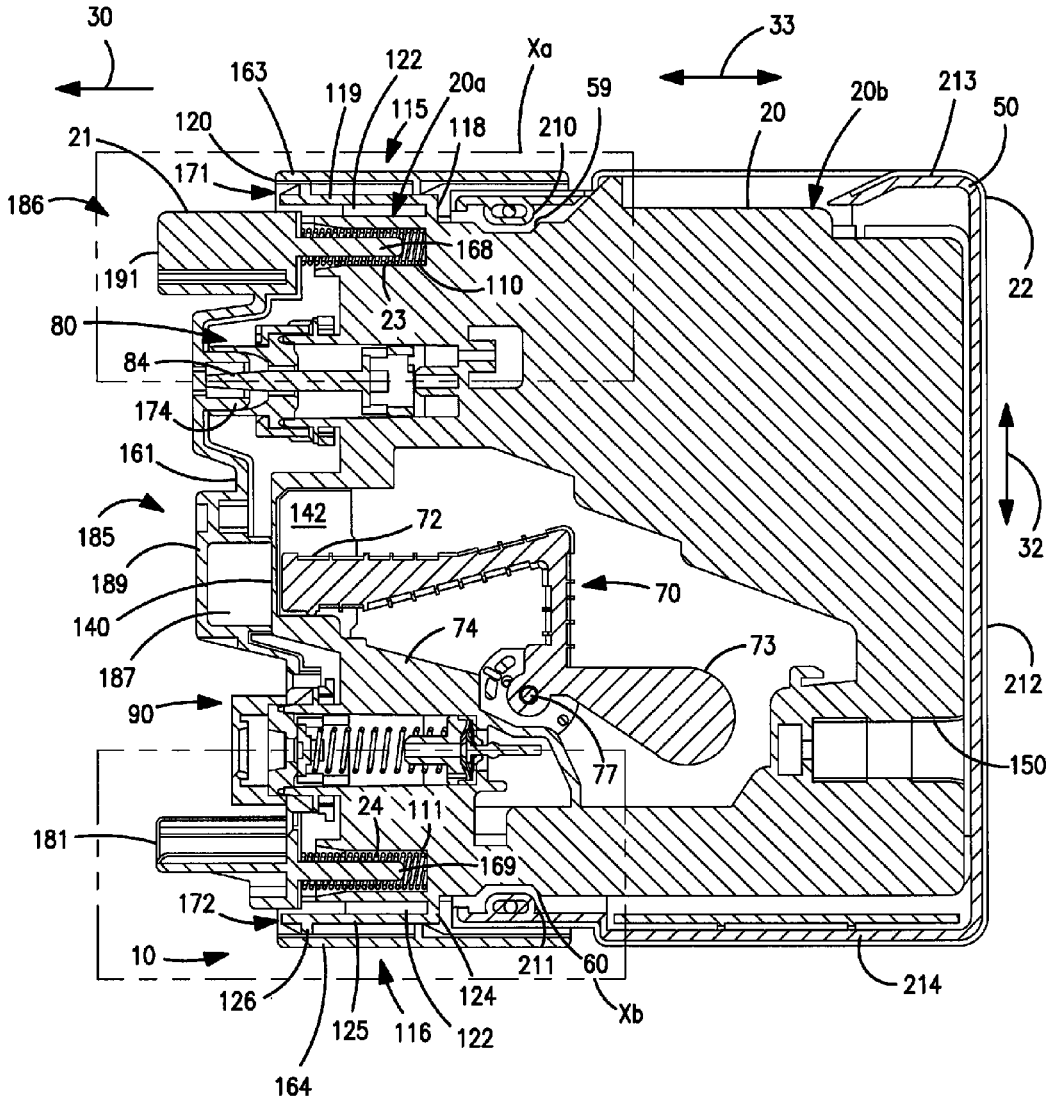
FIG. 8 is a cross-sectional view taken along the line VIII-VIII in FIG. 2(*a*).

Referring to FIG. 6, a spring storage chamber 110 may be formed in the front face 41 above the valve storage chamber 55, and a spring storage chamber 111 may be formed in the front face 41 below the valve storage chamber 54. The spring storage chambers 110 and 111 may be substantially cylindrical chambers extending from the front face 41 toward an ink chamber 100, such that at least a rear portion of spring storage chambers 110 and 111, respectively, define a portion of front face 41. Referring to FIG. 8, the coil springs 23 and 24 may be positioned within the valve storage chambers 110 and 111, respectively. For example, the coil springs 23 and 24 may be coupled to the front face 41 at one end and may be coupled to the movable member 21 at the other end. Specifically, the coil springs 23 and 24 may be coupled to the front face 41 and the movable member 21 by direct contact between the coil springs 23 and 24 and the front face 41 and the movable member 21, or by indirect contact between the coil springs 23 and 24 and the front face 41 and the movable member 21, i.e., with at least one other element positioned between the coil springs 23 and 24 and the front face 41 and the movable member 21. The coil springs 23 and 24 may be configured to resiliently urge the movable member 21 away from the front face 41 by applying a biasing force to the movable member 21. Moreover, in order to stably and evenly urge the movable member 21, the spring storage chamber 110 and the spring storage chamber 111 may be sufficiently separated from each other in the height direction of the main body 20, e.g., may be positioned adjacent to opposite ends of the face 42 in the height direction.

A supporting member 115 may formed at an front end of the top face 43 of the frame 50. The supporting member 115 supports the movable member 21, such that the movable member 21 may slide with respect to the main body 20, and the supporting member 115 limits the sliding range of the movable member 21. The movable member 21 may be slideably supported at two points by the supporting member 115 and a supporting member 116. The supporting member 115 may be integral with the frame 50. The supporting member 115 may comprise a first portion 118 extending vertically upward from the top face 43, a second portion 119 extending from an top end of the first portion 118 in the direction of insertion 30 in parallel to the top face 43, and a hook portion 120 formed at a front end of the second portion 119 and extending upward. A gap 122 may be formed between the second portion 119 and the top face 43, which may allow the second portion 119 to bend in the height direction of the main body 20.

The supporting member 116 may have substantially the same shape as the supporting member 115, and may be positioned at a front end of the bottom face 44 of the frame 50. The supporting member 116 may be integral with the frame 50, and may comprise a first portion 124 extending vertically downward from the bottom face 44, a second portion 125 extending from an end of the first portion 124 in the direction of insertion 30 in parallel to the bottom face 44, and a hook portion 126 formed at an front end of the second portion 125 and extending downward.

Figure 9:
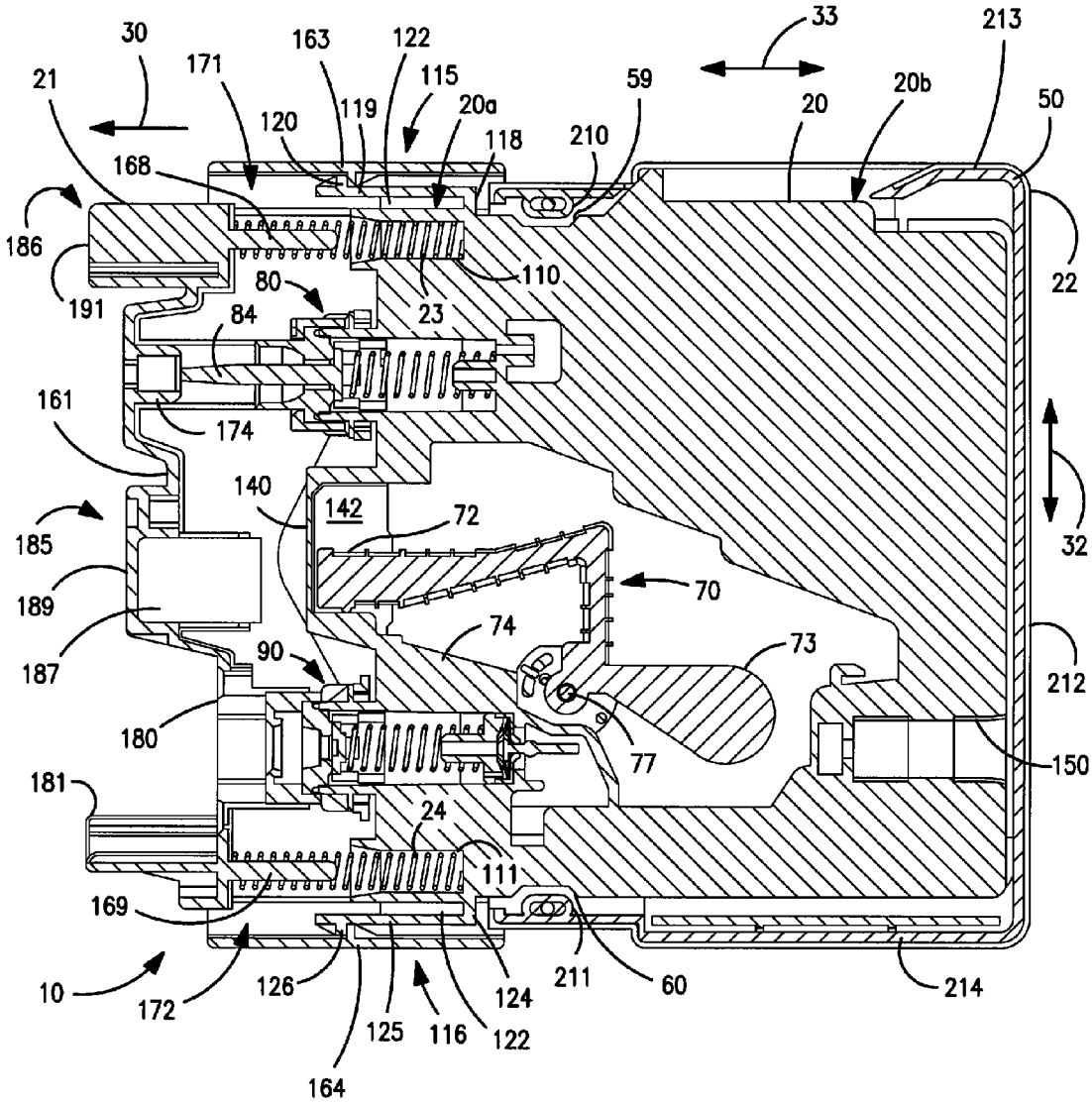
FIG. 9 is a cross-sectional view taken along the line IX-IX in FIG. 2(*b*).
Figure 10A:
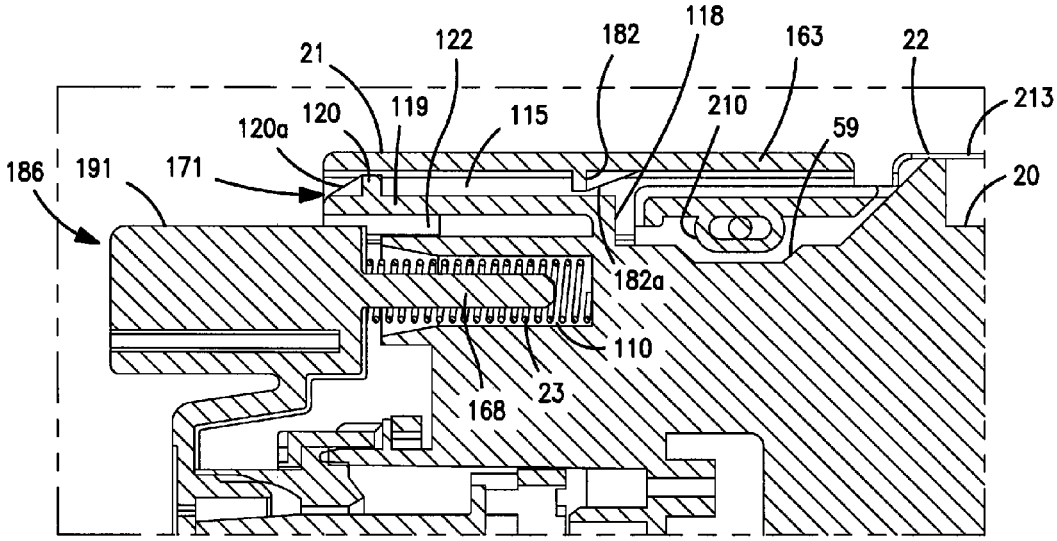
FIGS. 10(*a*) and 10(*b*) are enlarged, cross-sectional views of an upper portion and a lower portion, respectively, of the main body of FIGS. 4(*a*) and 4(*b*).
Figure 10B:
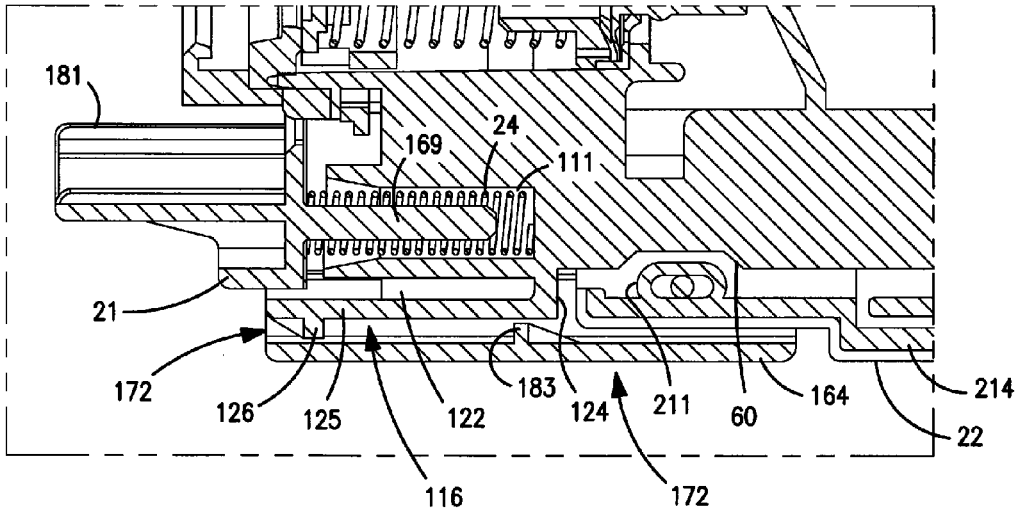

Referring to FIGS. 2(*a*)-3(*b*) and FIGS. 8-10(*b*), the movable member 21 and the cover member 22, according to an embodiment of the present invention, are depicted. The cover member 22 may have a container shape, and may be configured to accommodate the rear portion 20*b* of the main body 20 therein. The cover member 22 may have a flat shape corresponding to the outer shape of the rear portion 20*b*. The cover member 22 may comprise a rear wall 212 facing and covering the rear face 42 of the main body 20, a top wall 213 facing and covering the top face 43 of the main body 20, a bottom wall 214 facing and covering the bottom face 44 of the main body 20, a left wall 215 facing and covering the left side face 45 of the main body 20, and a right wall 216 facing and covering the right side face 46 of the main body 20. The walls 212-216 may define a space therein which is configured to accommodate the rear portion 20*b*. In an embodiment, a portion of the top wall 213 of the cover member 22 and a portion of the top face 43 of the main body 20 may define a latching recess 1000 therebetween. In another embodiment, a latching recess may be formed in the top face 43 of the main body 20, or may be formed in the top wall 213 of the cover member 22.

The projecting strips 210 and 211 may be positioned on the inner surface of the cover member 22 adjacent to the opening of the cover member 22. The projecting strips 210 and 211 may be at positions corresponding to the recessed portions 59 and 60. The projecting strip 210 may be fitted to the recessed portion 59 formed in the top face 43 of the main body 20, and the projecting strip 211 may be fitted to the recessed portion 60 formed in the bottom face 44 of the main body 20. Accordingly, the main body 20 and the cover member 22 may be securely engaged.

The movable member 21 may have a container shape, and may be configured to accommodate the front portion 20*a* of the main body 20 therein. The movable member 21 may have a flat shape corresponding to the outer shape of the front portion 20*a*. The movable member 21 may comprise a front wall 161 facing the front face 41 of the main body 20, a top wall 163 covering the top face 43 of the main body 20, a bottom wall 164 covering the bottom face 44 of the main body 20, a left wall 165 covering the left side face 45 of the main body 20, and a right wall 166 covering the right side face 46 of the main body 20. The walls 163-166 may define a space therein which is configured to accommodate the front portion 20*a*.

The left wall 165 and the right wall 166 may extend from the front wall 161 in the depth direction of the main body 20 and may cover the left side face 45 and the right side face 46 of the main body 20. Therefore, when the movable member 21 slides, the left wall 165 and the right wall 166 may act as guide surfaces for the left side face 45 and the right side face 46, such that the movable member 21 slides smoothly.

In an embodiment of the present invention, at least a portion of the movable member 21 may have substantially the same color as the color of ink stored in the ink chamber 100, such that the movable member 21 readily may indicate the ink color to a user.

In another embodiment of the present invention, the movable member 21 may comprise a signal blocking arrangement 185, a signal blocking arrangement 186, a cutout 187 formed therethrough, supporting bars 168 and 169, slide grooves 171 and 172, a pressing portion 174, and an opening 180 formed therethrough.

Referring to FIGS. 2(*a*)-3(*b*), the cutout 187 may be formed at a center of the front wall 161, and the cutout 187 may be configured to expose the translucent portion 140 to the outside when the movable member 21 is in the second position, such that at least a portion of the translucent portion 140 extends through the cutout 187 when the movable member 21 is in the second position. For example, the cutout 187 may be formed by removing rectangular portions from the front wall 161 and the side walls 165 and 166, facing the front wall 140*a* and the side walls 140*b* of the translucent portion 140. The cutout 187 may extend from the front wall 161 rearwardly in the direction of insertion 30. When the ink cartridge 10 is mounted to the cartridge mounting portion 276 (shown in FIG. 12), a light-emitting element and a light-receiving element of an optical sensor 230 (shown in FIG. 12) may sandwich the cutout 187. Therefore, light emitted from the light-emitting element may pass through the cutout 187, and the side wall 140*b* of the translucent portion 140 may be irradiated with the light.

The signal blocking arrangement 185 may comprise a signal blocking portion 189 projecting from the front wall 161 in the direction of insertion 30. The signal blocking portion 189 may be bridged over the cutout 187 in the vertical direction on the front wall 161. The signal blocking portion 189 may have a plate shape, and a space 190 may be formed behind the signal blocking portion 189. The ends on of the signal blocking portion 189 in the width direction and the cutout 187 may form rectangular openings in the side walls 165 and 166, respectively.

Figure 12:
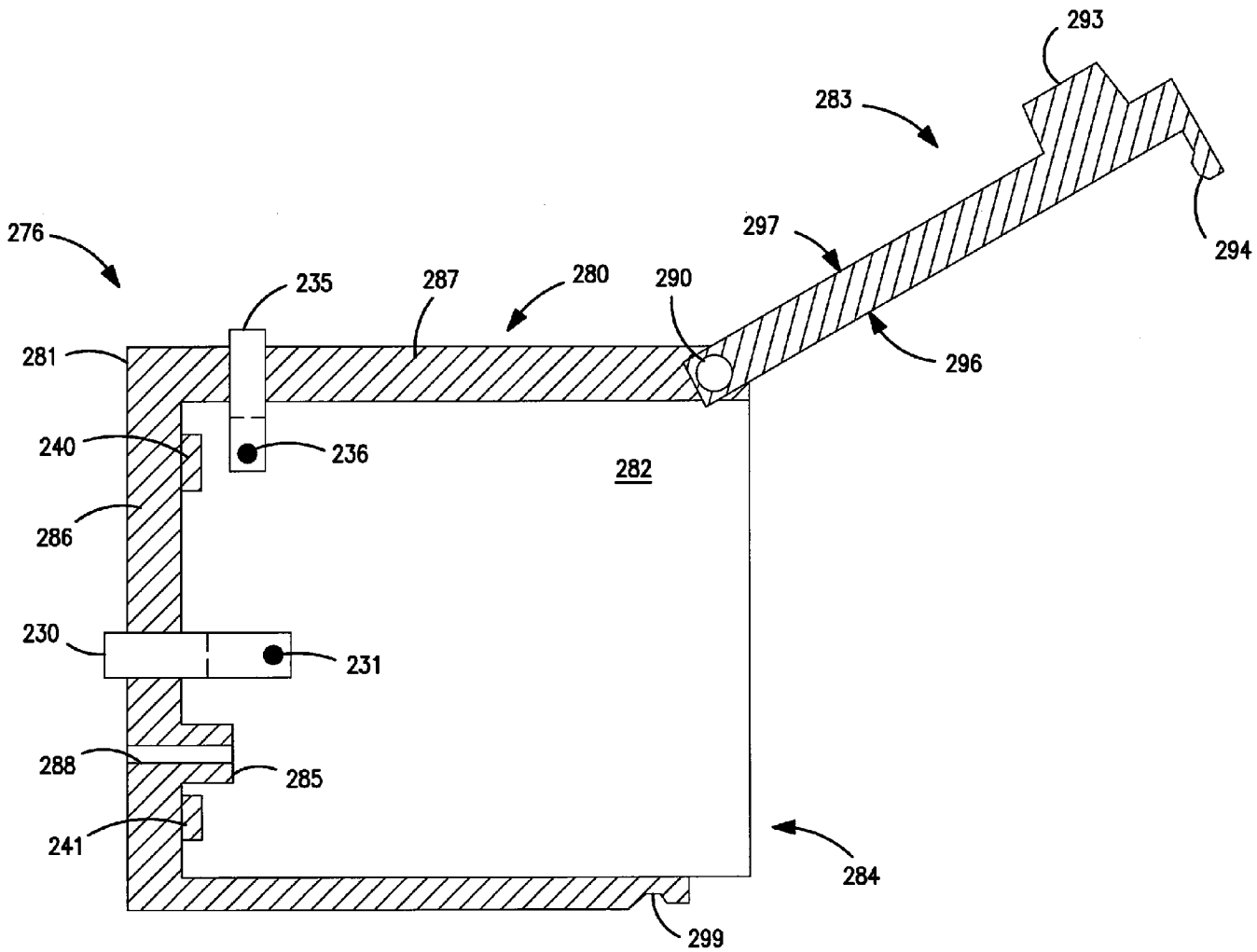
FIG. 12 is a vertical, cross-sectional view of a cartridge mounting portion of a recording apparatus, according to an embodiment of the present invention.
Figure 13:
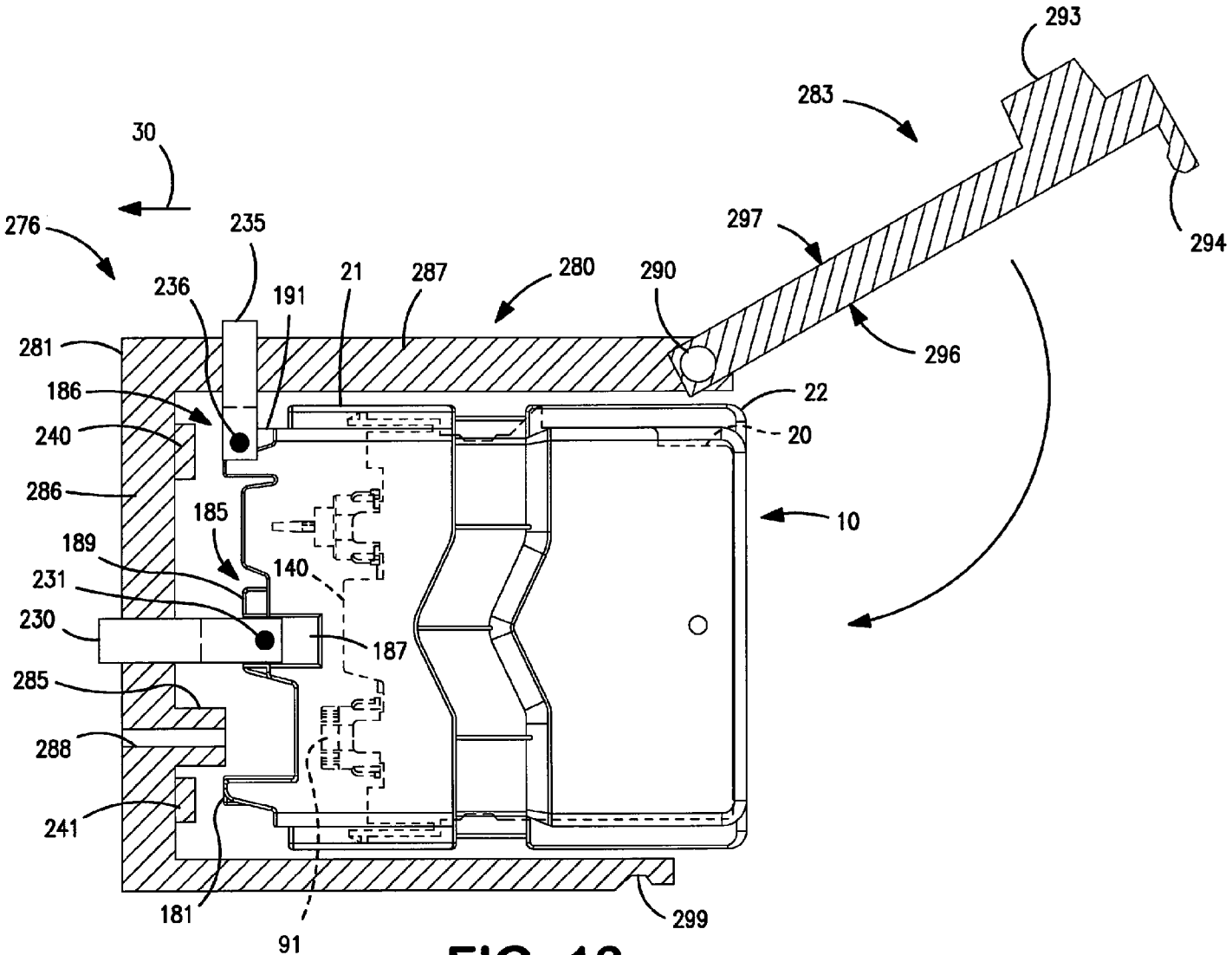
FIG. 13 is a cross-sectional view of an ink cartridge being mounted to the cartridge mounting portion of FIG. 12.
Figure 14:
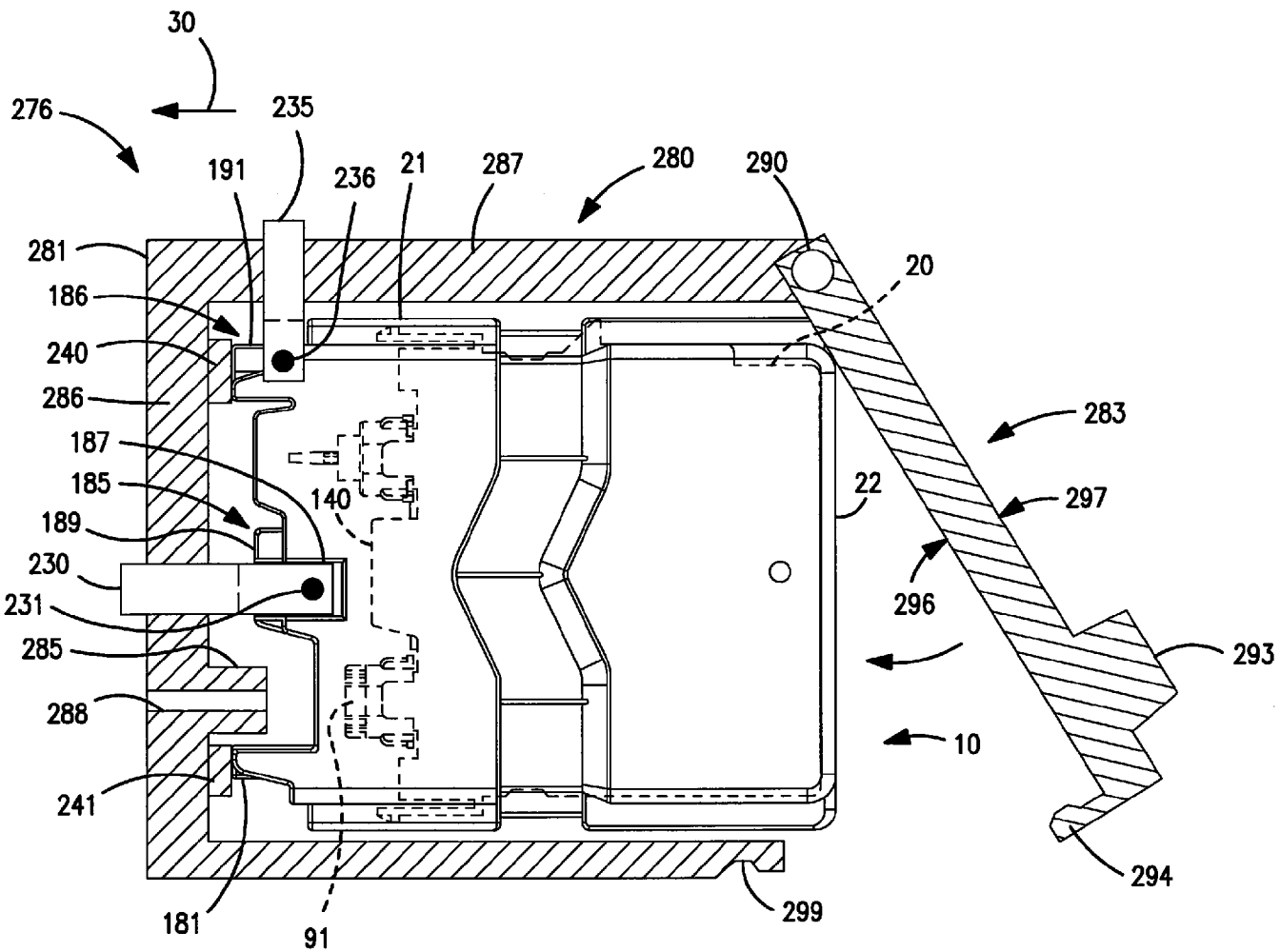
FIG. 14 is a cross-sectional view of an ink cartridge mounted to the cartridge mounting portion of FIG. 12, in which a lock lever of the recording apparatus is in an open position.
Figure 15:
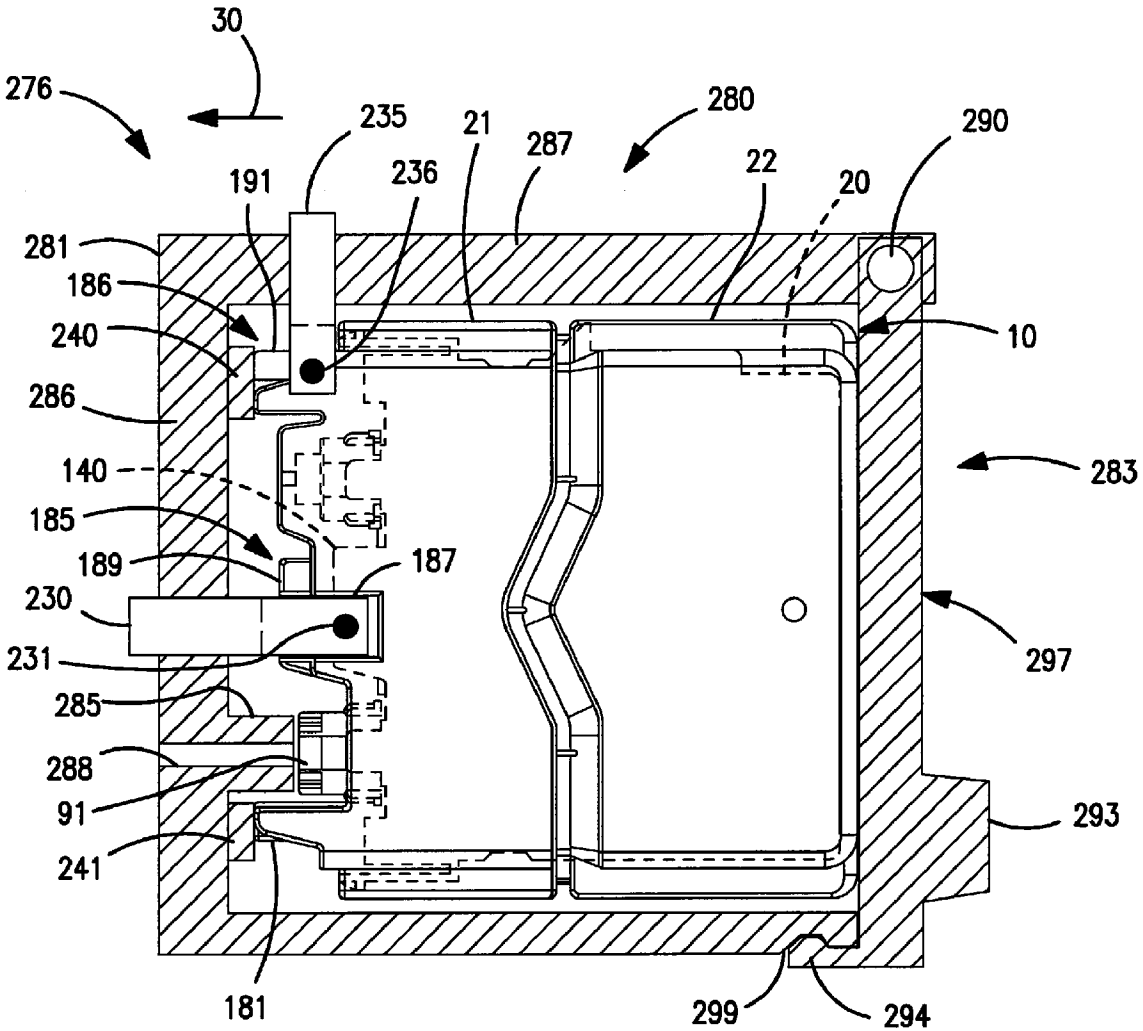
FIG. 15 is a cross-sectional view of an ink cartridge mounted to the cartridge mounting portion of FIG. 12, in which the lock lever of the recording apparatus is in a closed position.

Referring to FIG. 12, the signal blocking portion 189 may be configured to enter into an optical path 231 of the optical sensor 230 provided on the cartridge mounting portion 276 during the mounting of the ink cartridge 10 into the cartridge mounting portion 276. The signal blocking portion 189 may comprise a resin material which does not allow light to pass therethrough or alters the path of light traveling therethrough. The signal blocking arrangement 186 may be configured to enter into an optical path 236 of an optical sensor 235 provided on the cartridge mounting portion 276 during the mounting of the ink cartridge 10 to the cartridge mounting portion 276. The signal blocking arrangement 186 may comprise resin material which does not allow light to pass therethrough or alters a path of light passing therethrough. Referring to FIGS. 2(*a*)-3(*b*), the signal blocking arrangement 186 may be positioned at or adjacent to a distal end of the top wall 163, and the signal blocking arrangement 186 may project from the front wall 161 away from the front wall 161. The signal blocking arrangement 186 may comprise a signal blocking portion 191, e.g., a rib portion, and a pair of grooves 192 may be formed on opposite sides of the signal blocking portion 191. The signal blocking portion 191 may be inserted into the optical path 236 of the optical sensor 235. The signal blocking portion 191, the signal blocking portion 189, and the ink supply portion 90 may intersect a first plane, e.g. a plane which is parallel with the arrow 32 and the arrow 33 of FIGS. 2(*a*)-2(*d*), and the signal blocking portion 189 and the signal blocking portion 72 may intersect a second plane which is perpendicular to the first plane, e.g., a plane which is parallel with the arrow 31 and the arrow 33 of FIGS. 2(*a*)-2(*d*), when a sufficient amount of ink is stored in the ink chamber 100 and the signal blocking portion 72 is positioned in the inner space 142. With this configuration, a later-described procedure for determining the type of the ink cartridge readily may be performed.

The projecting portion 181 may be positioned at or adjacent to a lower end of the front wall 161, and may project away from the front wall 161. Distal ends of the projecting portion 181 and the signal blocking arrangement 186 may contact the innermost wall surface of the cartridge mounting portion 176 when the ink cartridge 10 is mounted to the cartridge mounting portion 276.

The supporting bar 168 may be configured to support the coil spring 23, and the supporting bar 169 may be configured to support the coil spring 24. The supporting bars 168 and 169 may be positioned on a surface of the front wall 161 facing the front face 41 of the main body 20. The supporting bar 168 may be at a position corresponding to the spring storage chamber 110, and the supporting bar 169 may be at a position corresponding to the spring storage chamber 111.

Referring to FIGS. 10(*a*) and 10(*b*), the supporting bars 168 and 169 may extend from the surface of the front wall 161 in the depth direction of the main body 20. When the front portion 20*a* of the main body 20 is inserted into the movable member 21 in a state in which the coil spring 23 is stored in the spring storage chamber 110 and the coil spring 24 is stored in the spring storage chamber 111, the supporting bar 168 is inserted into the coil spring 23 and the supporting bar 169 is inserted into the coil spring 24. Accordingly, the coil springs 23 and 24 may be supported by the supporting bars 168 and 169, respectively. The direction of expansion and contraction of the coil springs 23 and 24 may be limited to the depth direction of the main body 20.

The coil springs 23 and 24 may comprise compression coil springs, i.e., the coil springs 23 and 24 may be compressed and stored in the spring storage chambers 110 and 111 when the front portion 20*a* is inserted into the movable member 21. Therefore, the coil springs 23 and 24 may urge or bias the movable member 21 in the direction away from the front face 41 of the main body 20 independent of the position of the movable member 21.

Referring to FIGS. 2(*a*) and 2(*b*), the slide groove 171 may be formed in the top wall 163, and a cross-sectional shape of the slide groove 171 may substantially be an inverted U-shape. Referring to FIG. 10(*a*), the supporting member 115 may be inserted into the slide groove 171, and a projecting strip 182 may extend from a bottom surface of the top wall 163 toward an interior of the slide groove 171. Therefore, the slide groove 171 may be narrowed in part by the projecting strip 182. The slide groove 172 may be formed in the bottom wall 164, and a cross-sectional shape of the slide groove 172 may be substantially a U-shape. As shown in FIG. 10(*b*), the supporting member 116 may be inserted into the slide groove 172, and a projecting strip 183 may extend from a top surface of the bottom wall 164 toward an interior of the slide groove 172. Therefore, the slide groove 172 may be narrowed in part by the projecting strip 183.

During insertion of the front portion 20*a* of the main body 20 into the movable member 21, the supporting member 115 may be inserted into the slide groove 171, and the supporting member 116 may be inserted into the slide groove 172. When the supporting member 115 is inserted into the slide groove 171, the projecting strip 182 and the hook portion 120 may contact each other. Then, when the supporting member 115 is further inserted, the supporting member 115 may bend toward the gap 122, and the hook portion 120 may climb over the projecting strip 182 while a bevel 182*a* of the projecting strip 182 and a bevel 120*a* of the hook portion 120 slide over each other. When the hook portion 120 has climbed over the projecting strip 182 once, the movable member 21 and the main body 20 may not be disassembled because the hook portion 120 is received by the projecting strip 182 when the disassembly is attempted. The supporting member 116 also may be inserted into the slide groove 172 in the same manner.

When the front portion 20*a* is inserted into the movable member 21, the movable member 21 is urged away from the front face 41 by the coil springs 23 and 24. Therefore, unless an external force is applied to the movable member 21, the movable member 21 remains in the first position (shown in FIGS. 2(*b*) and 9) corresponding to the movable member's 21 furthest distance from front face 41 of the main body 20. The movable member 21 remains in the first position by the contact between the projecting strip 182 and the hook portion 120 and the contact between the projecting strip 183 and the hook portion 126. On the other hand, when an external force is applied to the front face of the movable member 21, the movable member 21 slides from the first position to the second position (shown in FIGS. 2(*a*) and 8) corresponding to the movable member's 21 closest distance to front face 41 of the main body 20.

Referring to FIGS. 8 and 9, the pressing portion 174 may be positioned on the surface of the front wall 161 facing the front face 41 of the main body 20. The pressing portion 174 may be at a position corresponding to the rod 84 of the air intake portion 80. The pressing portion 174 may be separated from a distal end of the rod 84 when the movable member 21 is in the first position, and the pressing portion 174 comes into contact with the distal end of the rod 84 while the movable member 21 slides from the first position toward the second position. Then, when the movable member 21 further slides toward the second position, the rod 84 is pushed toward the ink chamber 100 to open the air communicating port 81.

The opening 180 may be formed through the front wall 161 at a position adjacent to a lower end of the front wall 161, and may be formed at a position corresponding to the ink supply portion 90. The diameter of the opening 180 may be greater than the diameter of the cap 95 of the ink supply portion 90, such that the cap 95 may be inserted into and through the opening 180. When the movable member 21 is in the first position, the entire ink supply portion 90 may be positioned within the movable member 21, such that the entire ink supply portion 90 is recessed from the opening 180. As the movable member 21 moves from the first position to the second position, at least a portion of the ink supply portion 90 may move into and then may pass through the opening 180 to protrude from the front wall 161. Referring to FIGS. 2(*a*), 2(*b*), 3(*a*), and 3(*b*), in an embodiment of the present invention, the air intake portion 80 may be covered by the front wall 161, such that the air intake portion 80 is not exposed to the outside of the ink cartridge 10. In this embodiment, relatively small air holes (not numbered but shown in FIGS. 2(*a*) and 2(*b*)) may be formed in front wall 161 to allow air to be drawn into the air intake portion 80. Nevertheless, referring to FIGS. 2(*c*), 2(*d*), 3(*c*), and 3(*d*), an opening 180' may be formed through the front wall 161 adjacent to and aligned with the intake portion 80. In this embodiment, when the movable member 21 is in the first position, the entire air intake portion 80 may positioned within the movable member 21, such that the entire air intake portion 80 is recessed from the opening 180. As the movable member 21 moves from the first position to the second position, the air intake portion may remain entirely within the movable member 21, however, the air intake portion may move closer to the opening 180'. In this embodiment, air may be drawn into the ink chamber 100 when a component of the printer contacts and applies a force to the rod 84 of the air intake portion 80 via opening 180'.

Figure 11B:
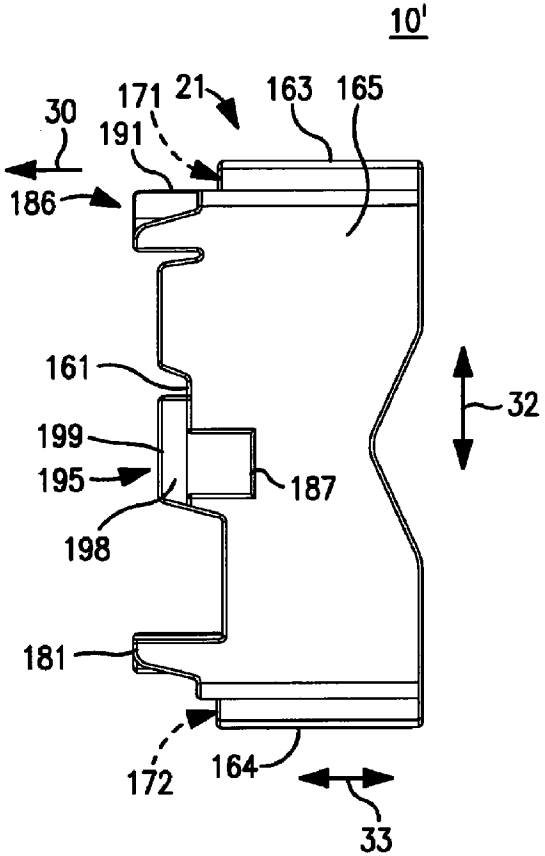
FIGS. 11(*a*) and 11(*b*) are perspective and side views, respectively, of a movable member, according to another embodiment of the present invention.
Figure 11A:
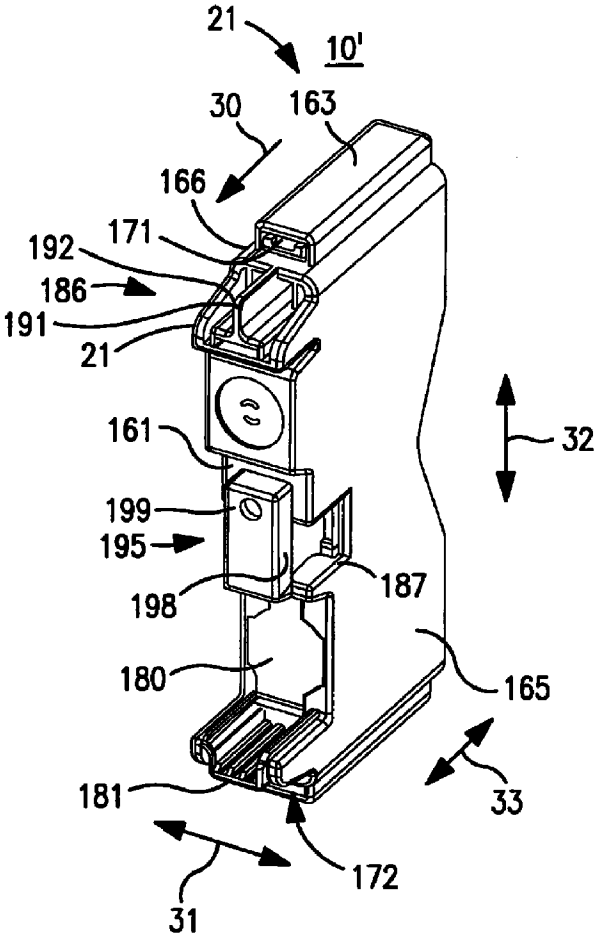

Referring to FIGS. 11(*a*) and 11(*b*), in an embodiment of the present invention, ink cartridge 10 may be replaced by ink cartridge 10'. Specifically, in ink cartridge 10', the signal blocking arrangement 185 may be replaced by a signal blocking arrangement 195 which has a different shape than the signal blocking arrangement 185. The signal blocking arrangement 195 may comprise a signal blocking portion 199 projecting from the front wall 161. The signal blocking portion 199 may be bridged over the cutout 187 in the vertical direction on the front wall 161. The signal blocking portion 199 may comprise a front wall and a pair of side walls 198 at both ends in the width direction. The side walls 198 may extend from the front wall of the signal blocking portion 199 to the front wall 161 of the movable member 21. The side walls 198 and the cutouts 187 may form rectangular openings in the side walls 165 and 166. The signal blocking portion 199 may be configured to enter into the optical path 231 of the optical sensor 230 provided on the cartridge mounting portion 276 during the mounting of the ink cartridge 10 to the cartridge mounting portion 276. The signal blocking portion 199 may comprise resin material which does not allow light to pass therethrough or alters the path of light passing therethrough. The signal blocking portion 191, the signal blocking 199, and the ink supply portion 90 may intersect a first plane, e.g. a plane which is parallel with the arrow 32 and the arrow 33 of FIGS. 2(*a*)-2(*d*), and the signal blocking portion 199 and the signal blocking portion 72 may intersect a second plane which is perpendicular to the first plane e.g., a plane which is parallel with the arrow 31 and the arrow 33 of FIGS. 2(*a*)-2(*d*), when a sufficient amount of ink is stored in the ink chamber 100 and the signal blocking portion 72 is positioned in the inner space 142. With this configuration, a later-described procedure for determining the type of the ink cartridge readily may be performed.

Referring to FIG. 12, according to an embodiment of the present invention, the cartridge mounting portion 276 may comprise a plurality, e.g., four, cases 280 corresponding to different colors, e.g., cyan, magenta, yellow, and black, arranged in parallel in the widthwise direction. Each case 280 may comprise a case body 281 and a lock lever 283. The case body 281 may comprise a storage chamber 282 configured to store the ink cartridge 10 therein, and an opening 284 may be formed through the front side of the case body 281. The case 280 may be configured to allow the ink cartridge 10 and 10' to be mounted to and removed from the case body 281 via the opening 284.

The optical sensor 230 and the optical sensor 235 may be positioned on the closed end side of the storage chamber 282. The optical sensor 230 may be positioned at a wall surface 286 which comprises the closed end of the storage chamber 282. The optical sensor 230 may be configured (a) to detect the type of the ink cartridge 10 and 10' mounted to the case 280; and (b) to detect whether the amount of ink in the ink cartridge 10 and 10' is less than or equal to a predetermined amount of ink, e.g., an amount of ink sufficient to render an image onto a recording medium. For example, the optical sensor 230 may comprise a photo interrupter including a light-emitting element and a light-receiving element. The optical sensor 230 may be coupled to the main controller 200, and electric signals outputted from the light-receiving element may be supplied to the main controller 200. The optical path 231 may be formed between the light-emitting element and the light-receiving element of the optical sensor 230. The type of the ink cartridge may be determined on the output signal, which corresponds to the intensity of received light, of the optical sensor 230 when the signal blocking arrangement 185 or the signal blocking arrangement 195 is inserted into the optical path 231.

The optical sensor 235 may be positioned at the inner side of a wall surface 287 which comprises the top of the case body 281. The optical sensor 235 may be configured to detect whether the signal blocking portion 191 of the signal blocking arrangement 186 is present at a predetermined position, such that whether or not the ink cartridge 10 is mounted may be determined. For example, the optical sensor 235 may comprise a photo interrupter comprising a light-emitting element and a light-receiving element. The optical sensor 235 may be coupled to the main controller 200, and electric signals outputted from the light-receiving element may be supplied to the main controller 200. When light is blocked by the signal blocking portion 191 in the optical path 236 of the optical sensor 235, the intensity of light received by the light-receiving element may be substantially instantaneously reduced.

A connecting portion 285 may be positioned at the lower portion of the wall surface 286 and may be configured to be connected to the ink supply port 91. The connecting portion 285 may project from the wall surface 286 toward the interior of the storage chamber 282. A through hole 288 may be formed through the connecting portion 285, and an ink tube may be inserted into the through hole 288. The through hole 288 may be formed at a position corresponding to the ink supply port 91. A tube may be provided on the inner side of the connecting portion 285, and when the ink cartridge 10 is mounted in the case 280, the tube may be inserted into the ink supply port 91, such that the ink supply port 91 and the connecting portion 285 are connected to each other.

A contact portion 240 may be positioned at the upper portion of the wall surface 286, and a contact portion 241 may be positioned at the lower portion of the wall surface 286. When the ink cartridge 10 is inserted into the case 280, the contact portion 240 may contact the distal end of the signal blocking arrangement 186, and the contact portion 241 may contact the distal end of the projecting portion 181.

The lock lever 283 may be configured to selectively open and close the opening 284, and to reliably secure the ink cartridge 10 in the storage chamber 282. The lock lever 283 may be supported at one end, so as to be rotatable about an axis 290 at the upper edge of the opening 284. The lock lever 283 may comprise an operating portion 293 and a claw 294. The operating portion 293 may be positioned at an outer surface 297 of the lock lever 283 adjacent the other end of the lock lever, and the claw 294 may be positioned at the other end of the lock lever 283. A groove 299 may be formed at the lower edge of the opening 284, and may be configured to engage the claw 294.

Referring to FIGS. 2(*a*), 2(*b*), 8, and 13-15, a process for mounting or inserting the ink cartridge 10 into the case 280 is depicted. When the ink cartridge 10 is inserted into the storage chamber 282 of the case 280, the signal blocking portion 189 of the signal blocking arrangement 185 may first enter into the optical path 231 of the optical sensor 230. Then, when the ink cartridge 10 is further inserted into the storage chamber 282, the signal blocking portion 191 of the signal blocking arrangement 186 enters into the optical path 236 of the optical sensor 235. At a time when the signal blocking portion 191 enters into the optical path 236, the signal blocking portion 189 has passed through the optical path 231 of the optical sensor 230, and light emitted from the light-emitting element passes through the space 190 behind the signal blocking portion 189.

When the ink cartridge 10 is inserted to the closed end of the storage chamber 282, the distal end of the signal blocking arrangement 186 contacts the contact portion 240, and the distal end of the projecting portion 181 contacts the contact portion 241. At this time, the cutout 187 has entered into the optical path 231.

When the lock lever 283 is rotated in the direction to close the opening 284, an inner surface 296 of the lock lever 283 contacts the rear wall of the cover member 22 and presses the ink cartridge 10 in the direction of insertion. At this time, the coil springs 23 and 24 are compressed. Accordingly, the main body 20 moves in the direction of insertion in a state in which the movable member 21 is stationary and the main body 20 moves toward the movable member 21.

When the main body 20 is further moved in the direction of insertion, the ink supply port 91 is connected to the connecting portion 285, and the translucent portion 140 enters into the cutout 187 and into the optical path 231 of the optical sensor 230.

When the lock lever 283 is completely closed, and the claw 294 engages with the groove 299, the lock lever 283 is locked with respect to the opening 284, and the opening 284 is closed by the lock lever 283. At this time, the main body 20 of the ink cartridge 10 receives an urging force of the coil springs 23 and 24, and the rear wall of the cover member 22 is pressed against the inner surface 296 of the lock lever 283.

Figure 16:
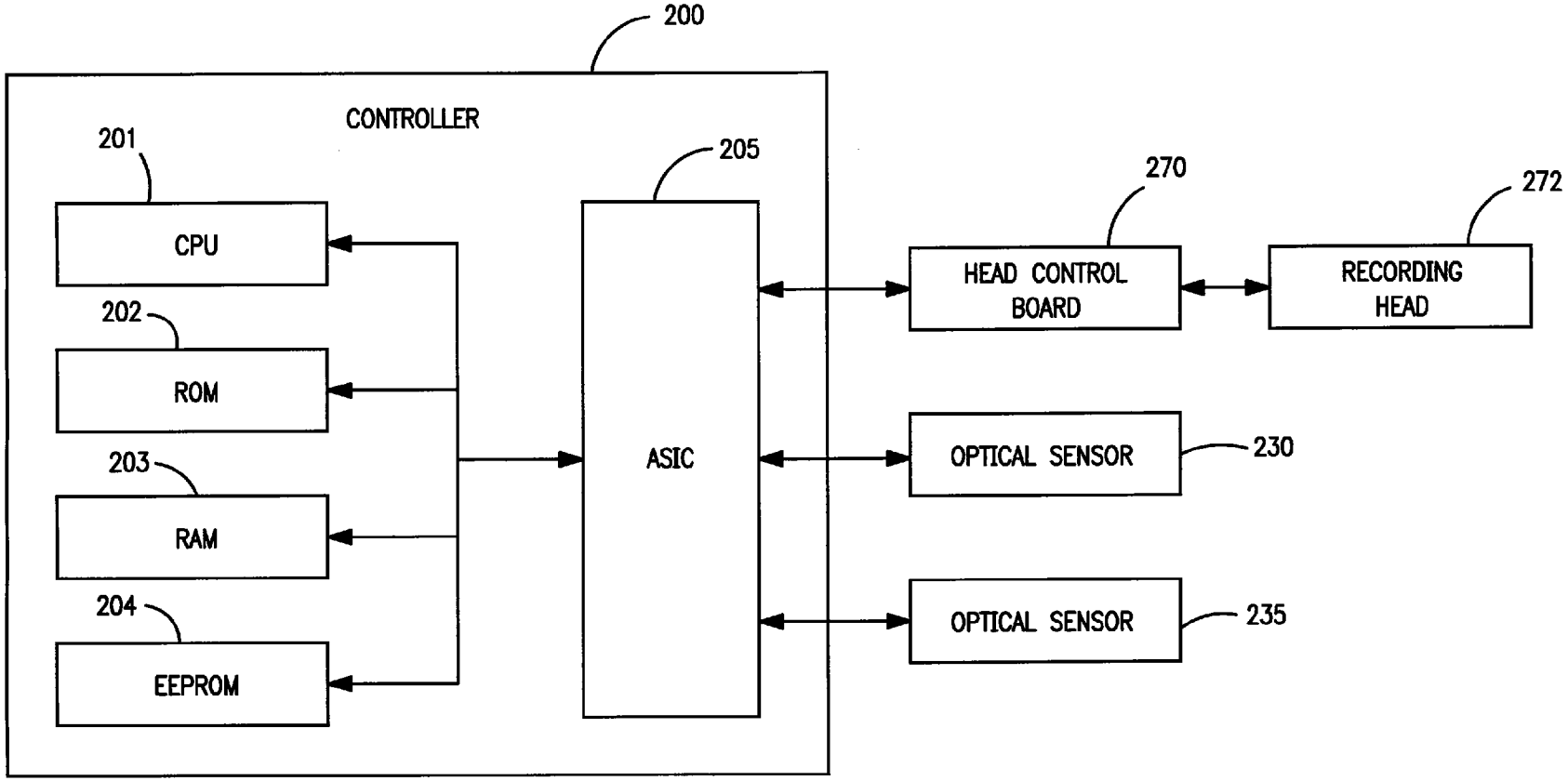
FIG. 16 is a block diagram of a main controller of the recording apparatus, according to an embodiment of the present invention.

Referring to FIG. 16, the main controller 200 may control the operation of the recording apparatus 250. The main controller 200 may be a micro computer comprising a central processing unit (CPU) 201, a read only memory (ROM) 202, a random access memory (RAM) 203, an electrically erasable programmable read only memory (EEPROM) 204, and an application specific integrated circuit (ASIC) 205.

The ROM 202 may store a program used by the CPU 201 for controlling the respective operations of the recording apparatus 250, and a program for discriminating the type of the ink cartridge 10 and 10'. The RAM 203 may be a storage area or a work area for temporarily storing the respective data used by the CPU 201 for executing the programs. The EEPROM 204 may store settings, flags, or the like to be retained, even after the power is turned off.

Referring to FIGS. 1 and 16, the head control board 270, the optical sensor 230, and the optical sensor 235 may be coupled to the ASIC 205. A drive circuit (not shown) for driving the respective rollers of the paper feeding apparatus 252 and the transferring apparatus 253, an input unit for entering printing instruction or the like to the recording apparatus 250, and a display device for displaying information relating the recording apparatus 250, also may be connected to the ASIC 205.

The head control board 270 may control the recording head 272 based on the signals, e.g., control signal and image signal, supplied from the ASIC 205. Accordingly, the ink may be selectively discharged at a predetermined timing from the nozzle 274 of the recording head 272.

The optical sensor 230 may output sensor signals based on the intensity of light received by the light-receiving element. For example, analog electric signals, such as voltage signals or current signals, may be outputted from the optical sensor 230 based on the intensity of light received by the light-receiving element. The sensor signal outputted from the optical sensor 230 may be supplied to the main controller 200, and the main controller 200 may determine that the sensor signal is a HIGH level signal when the electrical level, e.g., voltage value or current value, of the sensor signal is greater than or equal to a predetermined threshold value, and may determine that the sensor signal is a LOW level signal when the electrical level is less than the threshold value. For example, it may be determined that the sensor signal is a LOW level signal when the optical path 231 of the optical sensor 230 is blocked, and that the sensor signal may be a HIGH level signal when the optical path 231 is not blocked.

The optical sensor 235 may function in substantially the same way as the optical sensor 230, and may output sensor signals based on the intensity of light received by the light-receiving element.

Figures 17A, 17B, 17C, 17D:
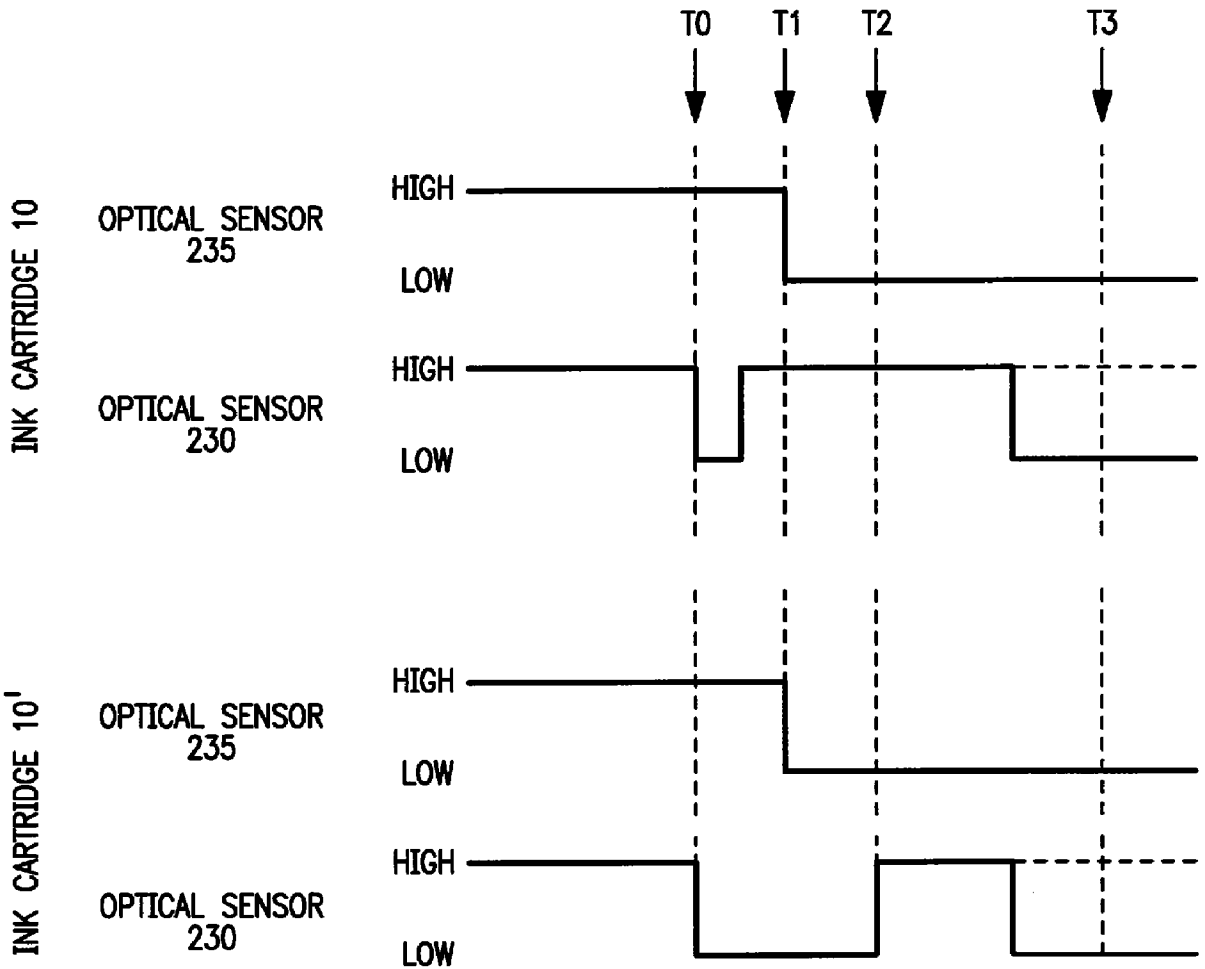
FIGS. 17(*a*) and 17(*b*) are exemplary timing diagrams of a sensor signal outputted from a first optical sensor and a second optical sensor, respectively, of the recording apparatus when a first ink cartridge is mounted to the cartridge mounting portion.

Referring to FIGS. 17(*a*) and 17(*b*), exemplary time profiles of signal levels of the sensor signals outputted from the optical sensor 230 and the optical sensor 235 during the mounting of the ink cartridge 10 are depicted, and referring to FIGS. 17(*c*) and 17(*c*), exemplary time profiles of signal levels of the sensor signals outputted from the optical sensor 230 and the optical sensor 235 during the mounting of the ink cartridge 10' are depicted.

As shown in FIGS. 17(*a*) and 17(*c*), the time profile of the signal level of the sensor signal outputted from the optical sensor 235 when the ink cartridge 10 is mounted to the case 280 may be the same as the time profile of the signal level of the sensor signal outputted from the optical sensor 235 when the ink cartridge 10' is mounted to the case 280. Specifically, when the signal blocking portion 191 enters into the optical path 236 of the optical sensor 235 and blocks or alters the path of the light, the signal level changes from HIGH to LOW at the time T1. In the main controller 200, this change of the signal level from HIGH to LOW may be used as a trigger signal in a process for determining the type of the ink cartridge.

Referring to FIG. 17(*b*), when the ink cartridge 10 is mounted to the case 280, the signal blocking portion 189 enters into the optical path 231 and blocks or alters the path of the light at a time T0. At this time, the signal level of the sensor signal outputted from the optical sensor 230 changes from HIGH to LOW. Because the signal blocking portion 189 may be a flat plate, the duration in which the light is blocked or its path is altered may be relatively short. The signal blocking portion 189 passes through the optical path 231 and the space 190 enters the optical path after the time T0 and before the time T1. Therefore, at the time T1, the signal level of the optical sensor 230 has been restored from LOW to HIGH.

Subsequently, when the ink cartridge 10 is further inserted, the cutout 187 enters the optical path 231, and when the ink cartridge 10 is completely mounted to the case 280, the translucent portion 140 enters the optical path 231 via the cutout 187 between a time T2 and a time T3. In this state, the position of the signal blocking portion 72 may be detected. In FIG. 17(*b*), the signal level when the signal blocking portion 72 is in the optical path 231 is represented by a solid line (LOW level), and the signal level when the signal blocking portion 72 is out of the optical path 231 is represented by a broken line (HIGH level).

Referring to FIG. 17(*d*), when the ink cartridge 10' is mounted to the case 280, the signal blocking portion 199 also enters the optical path 231 to block the light or alter the path of the light at the time T0. At this time, the signal level of the sensor signal outputted from the optical sensor 230 changes from HIGH to LOW. Because the signal blocking portion 199 has the side walls 198, the duration during which the light is blocked or altered by the signal blocking portion 199 may be greater than the duration during which the light is blocked or altered by the signal blocking portion 189. Specifically, at the time T1, the side walls 198 still may be in the optical path 231.

Therefore, at the time T1, the signal level of the sensor signal outputted from the optical sensor 230 is maintained in the LOW state.

Subsequently, when the ink cartridge 10' is further inserted, at the time T2, the side walls 198 pass through the optical path 231, and the cutout 187 enters the optical path 231. At this time, the signal level of the optical sensor 230 is restored from LOW to HIGH. Then, when the ink cartridge 10' is completely mounted to the case 280, the translucent portion 140 enters the optical path 231 via the cutout 187 at a time between time T2 and Time T3. In this state, the position of the signal blocking portion 72 may be detected. In FIG. 17(*d*), the signal level when the signal blocking portion 72 is in the optical path 231 is represented by a solid line (LOW level), and the signal level when the signal blocking portion 72 is out of the optical path 231 is represented by a broken line (HIGH level).

The type of the ink cartridge may be determined by the main controller 200 based on the time profiles of the optical sensor 230 and the optical sensor 235.

Figure 18:
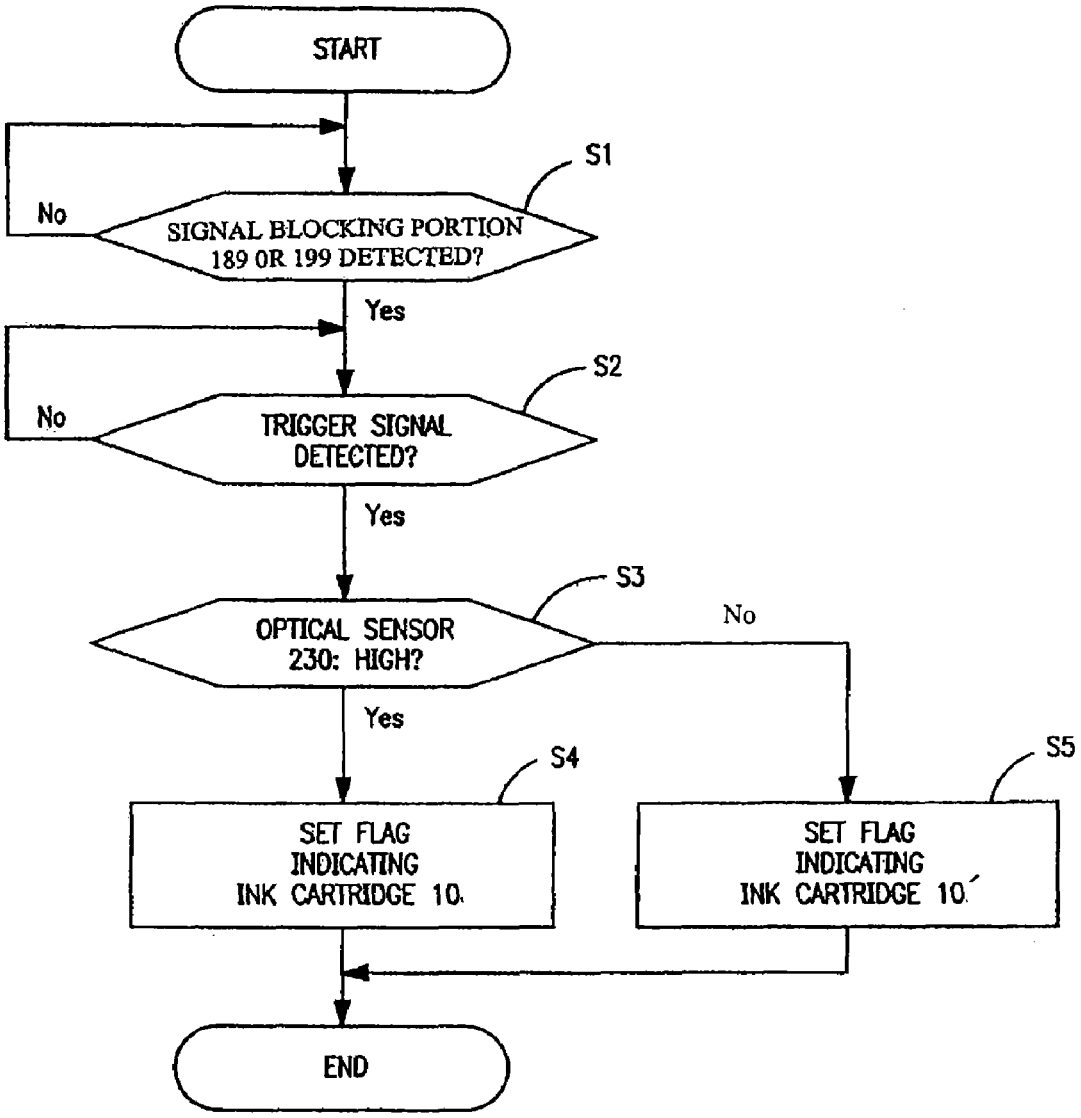
FIG. 18 is a flowchart of a procedure performed by the main controller of the recording apparatus, according to an embodiment of the present invention.

Referring to FIG. 18, a procedure for determining whether the mounted ink cartridge is the ink cartridge 10 or the ink cartridge 10' is depicted. In Step S1, the main controller 200 determines whether the signal blocking portion 189 or 199 has entered the optical path 231 of the optical sensor 230, e.g., it is determined whether or not the signal level of the sensor signal outputted from the optical sensor 230 has changed from HIGH to LOW. When the main controller 200 determines that the signal blocking portion 189 or 199 has entered the optical path 231, Step S2 is performed. Step S2 is not performed until the main controller 200 determines that the signal blocking portion 189 or 199 has entered the optical path 231.

In the Step S2, the main controller 200 determines whether the signal blocking portion 191 has entered the optical path 236, e.g., it is determined whether the signal level of the optical sensor 235 has changed from HIGH to LOW, which corresponds to a detection of a trigger signal. When the trigger signal is detected in Step S2, in Step S3, the main controller 200 determines whether the signal level of the sensor signal outputted from the optical sensor 230 at the time T1 when the trigger signal is detected is HIGH or LOW. For example, when the signal level at the time T1 is HIGH, the main controller 200 may determine that the ink cartridge 10 is inserted in the case 280, and when the signal level at the time T1 is LOW, the main controller may determine that the ink cartridge 10' is inserted in the case 280.

When it is determined that the signal level of the sensor signal outputted from the optical sensor 230 is HIGH in Step S3, a bit flag indicating that the installed ink cartridge corresponds to the ink cartridge 10 is set to a register, e.g., a register of the CPU 201. If a bit flag indicating that the installed ink cartridge corresponds to the ink cartridge 10' has been set previously, the bit flag indicating that the installed ink cartridge corresponds to the ink cartridge 10' is cleared, and the bit flag indicating that the installed ink cartridge corresponds to the ink cartridge 10 is set. On the other hand, when it is determined that the signal level of the sensor signal outputted from the optical sensor 230 is LOW, the bit flag indicating that the installed ink cartridge corresponds to the ink cartridge 10' is set to the register. If the bit flag indicating that the installed ink cartridge corresponds to the ink cartridge 10 has been set previously, the bit flag indicating that the installed ink cartridge corresponds to the ink cartridge 10 is cleared, and the bit flag indicating that the installed ink cartridge corresponds to the ink cartridge 10' is set. If the bit flag is set, the recording apparatus 250 or an information processing apparatus e.g. a personal computer connected to the recording apparatus 250, may display which of the ink cartridges 10 and 10' is inserted, based on the flag.

If signal level of the optical sensor 235 changes from Low to High, the determination process may start again. Moreover, the determination process may be executed when the lock lever 283 is opened, and the determination process may conclude when the lock lever 283 is closed.

The type of the ink cartridge 10 and 10' may be determined based on the signal level of the sensor signal outputted from the optical sensor 230 at the time T1 when the trigger signal is detected. Therefore, the configuration of the ink cartridge 10 and 10' allows the recording apparatus 250 to accurately determine the type of the ink cartridge 10 or 10' independent of the speed with which the user mounts the ink cartridge 10 or 10' to the printer and regardless of whether the user begins to insert the ink cartridge into the printer and then partially removes the ink cartridge before finally fully inserting the ink cartridge into the printer.

The above described process is configured to discriminate between the two types of the ink cartridges 10 and 10', however, three or more types of ink cartridges may be discriminated. Moreover, an ink cartridge containing black ink and an ink cartridge containing color ink other than the black ink may be discriminated, and an ink cartridge containing pigment ink and an ink cartridge containing dye ink also may be discriminated.

Figure 19:
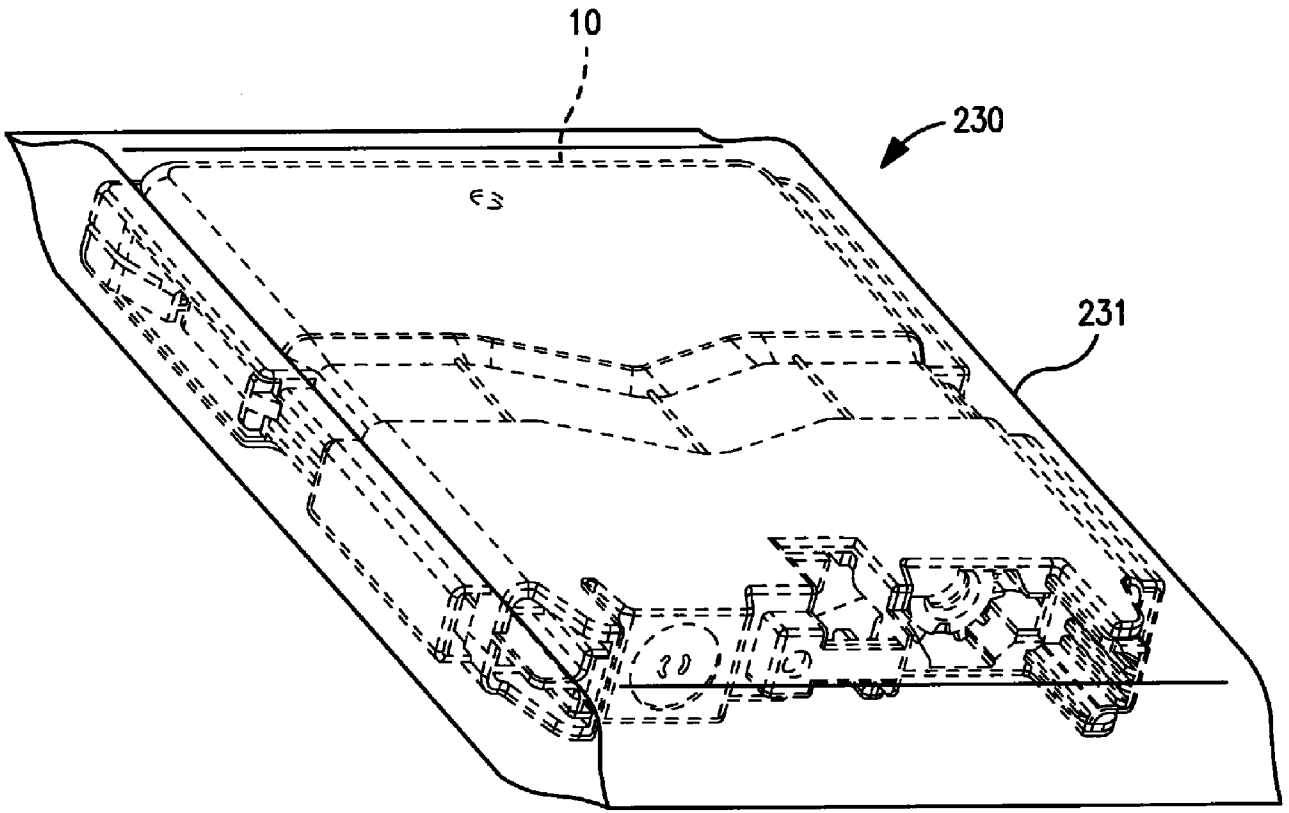
FIG. 19 is a perspective view of a packaging arrangement comprising the ink cartridge of FIGS. 2(*a*) and 2(*b*) enclosed in a packaging member, according to yet another embodiment of the present invention.

Referring to FIG. 19, a packaging arrangement 230, according to an embodiment of the present invention, is depicted. The packaging arrangement 230 may comprise an ink cartridge, e.g., the ink cartridge 10 (or 10'), and a packaging member 231. The ink cartridge 10 may be accommodated in an interior of the packaging member 231. The ink cartridge 10 may be shipped and sold in the packaging arrangement 230.

The interior of the ink chamber 100 may be depressurized to a pressure less than the atmospheric pressure by, for example, a vacuum pump to reduce an amount of air dissolved in the ink in the ink chamber 100. The interior of the packaging member 231 also may be depressurized to a pressure less than the atmospheric pressure by, for example, a vacuum pump to prevent air from entering into the ink chamber 100 through the films covering the side faces 45 and 46.

The packaging member 231 may be liquid-proof but may have some gas permeability. Therefore, air may enter the interior of the packaging member 231 when the packaging arrangement 230 is left unused for an extended period of time. Nevertheless, if a depressurized space exists in the interior of the packaging member 231, the interior of the packaging member 231 may be maintained at a stable depressurized state for an extended period of time.

The packaging arrangement 230 may be manufactured as follows. The ink cartridge 10 may be accommodated in the interior of the packaging member 231 in a state in which the movable member 21 is held at the first (extended) position shown in FIG. 2(*b*). While maintaining this state, the pressure in the interior of the packaging member 231 may be reduced to a pressure which is less than the atmospheric pressure, and the packaging member 231 may be sealed. Because the ink cartridge 10 may be accommodated in the packaging member 231 in this manner, the depressurized space of a predetermined capacity may be formed between the front face 41 of the main body 20 and the front wall 161 of the movable member 21 in the interior of the packaging member 231. Therefore, the interior of the packaging member 231 may be maintained as the depressurized state for an extended period of time.

Nevertheless, if the interior of the packaging member 231 is depressurized too much, a pressure difference between the atmospheric pressure and the pressure in the interior of the packaging member 231 may become so great that a relatively large force acts on the ink cartridge 10. In this case, if the depressurized space is formed between the front face 41 of the main body 20 and the front wall 161 of the movable member 21, the movable member 21 may deform inward and may not be restored to an original shape. Therefore, in another embodiment of the present invention, the ink cartridge 10' may be accommodated in the packaging member 231 in a state in which the movable member 21 is held at the second (retracted) position shown in FIG. 2(*c*). When the movable member 21 is at the second position, the depressurized space between the front face 41 of the main body 20 and the front wall 161 of the movable member 21 is relatively small, and therefore, the deformation of the movable member 21 may be prevented. The size of the packaging arrangement 230 may also be reduced. Because the depressurizes space still exits even though it is relatively small, the interior of the packaging member 231 may be maintained at a stable depressurized state for a reasonable period of time.

Figure 20:
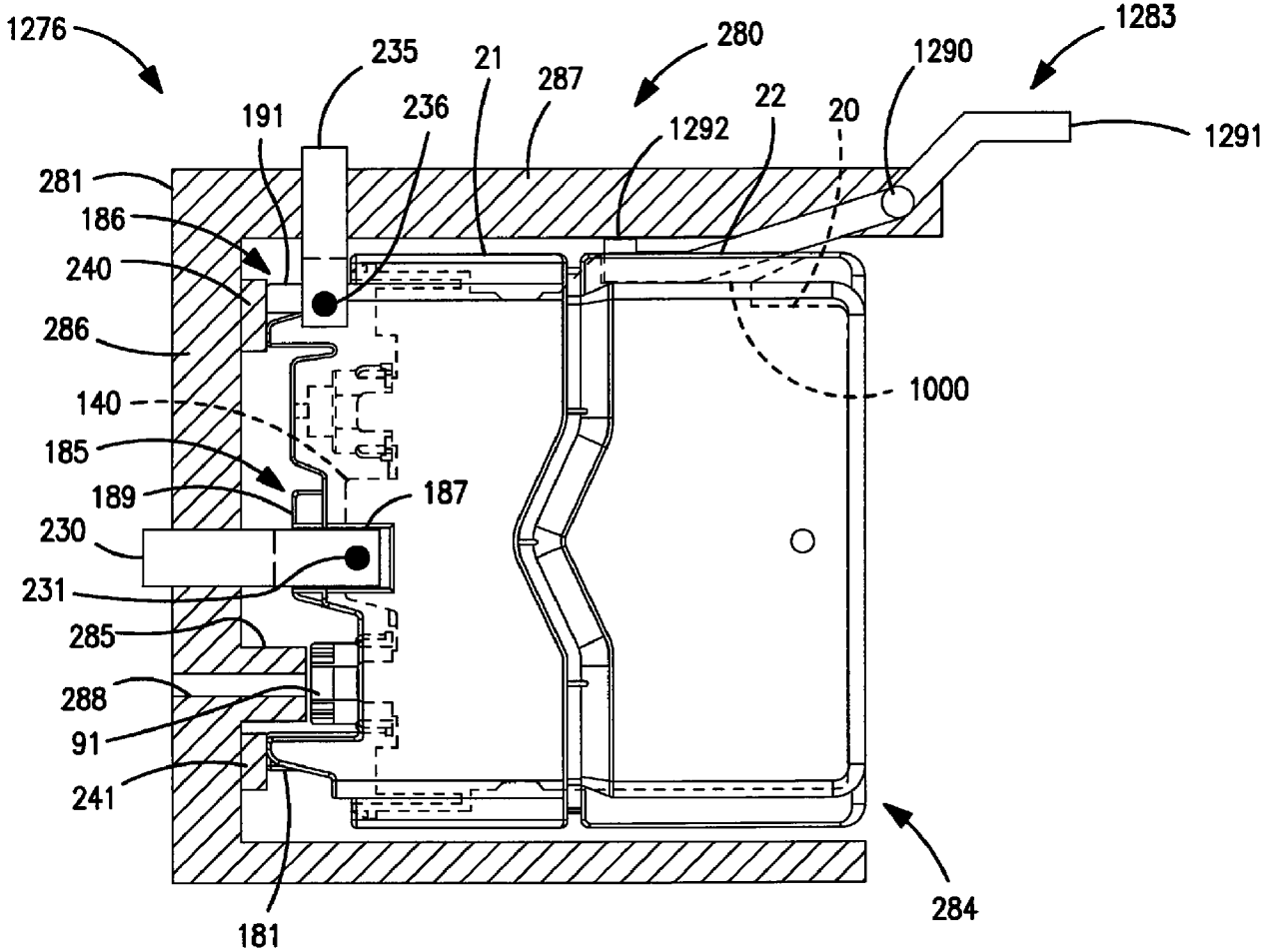
FIG. 20 is a cross-sectional view of an ink cartridge mounted to the cartridge mounting portion, according to another embodiment of the present invention.
Figure 21:
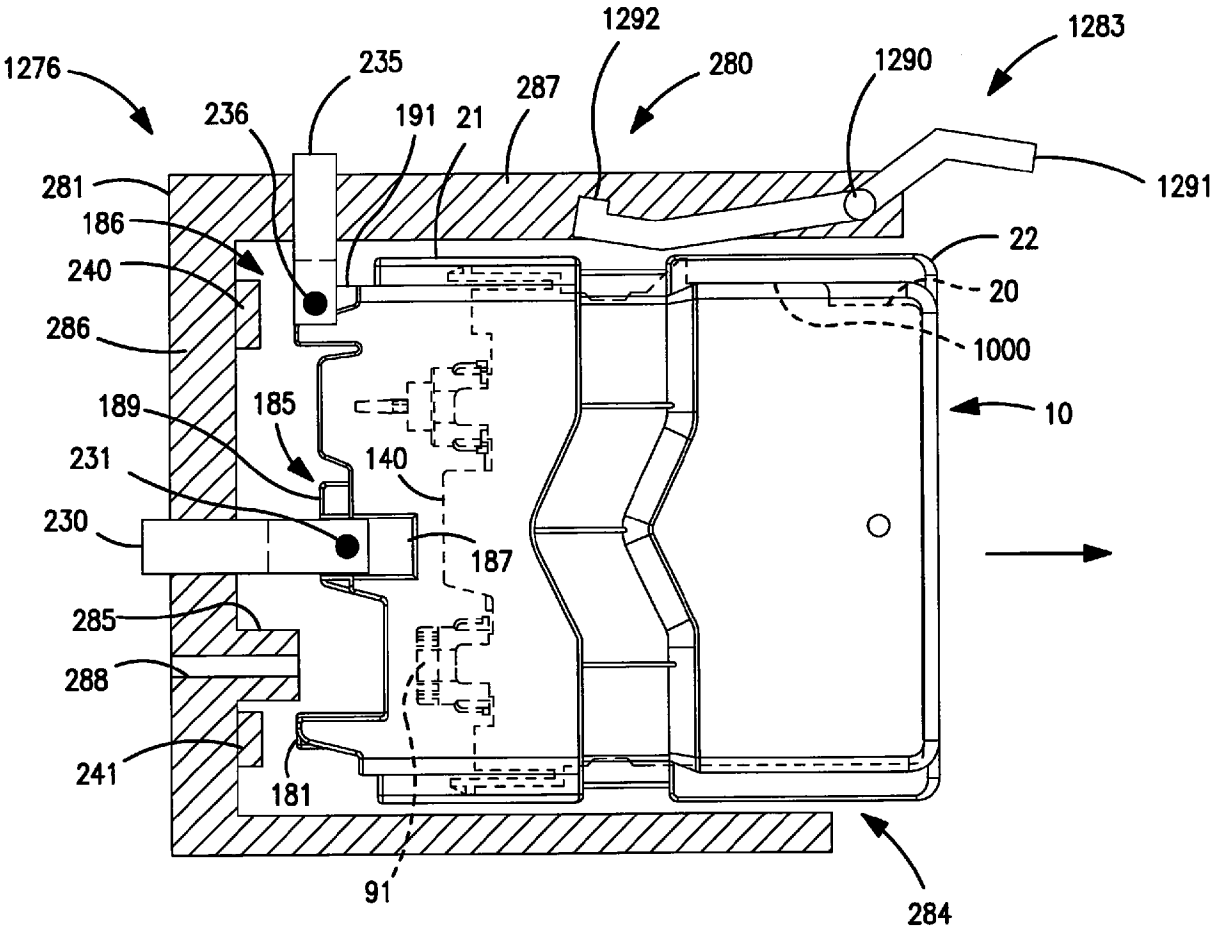
FIG. 21 is a cross-sectional view of the ink cartridge being ejected from the cartridge mounting portion of FIG. 20.

Referring to FIGS. 20 and 21 a cartridge mounting portion 1276, according to another embodiment of the present invention, is depicted. The cartridge mounting portion 1276 may comprise a lock lever 1283 instead of the lock lever 283 of the cartridge mounting portion 276. The lock lever 283 may comprise a first portion 1291, a second portion 1292, and a pivot portion 1290 between the first portion 1291 and the second portion 1292. The pivot portion 1290 is supported at the upper portion of the case 280 adjacent to the opening 284 such that the lock lever 1283 may pivot about the pivot portion 1290. The first portion 1291 extends from the pivot portion to the outside of the case 280, and the second portion 1292 extends from the pivot portion 1290 to the storage chamber 282. The first portion 1291 may be positioned above the second portion 1292 because the weight of the first portion 1291 is less than the weight of the second portion 1292. As shown in FIG. 20, when the ink cartridge 10 is installed in the cartridge mounting portion 1276, a portion of the second portion 1292 contacts a portion of the latching recess 1000. The main body 20 of the ink cartridge 10 receives the urging force of the coil springs 23 and 24 toward the opening 284. Nevertheless, because the portion of the second portion 1292 contacts the portion of the latching recess 1000 to retain the main body 20 in the case 280 against the urging force of the coil springs 23 and 24, the ink cartridge 10 remains in the case 280.

When a user intends to remove the ink cartridge 10 from the cartridge mounting portion 1276, the user applies a downward force to an end portion of the first portion 1291. The lock lever 1283 then pivots about the pivot portion 1290, as shown in FIG. 21, and the second portion 1292 moves up and separates from the latching recess 1000. Consequently, the coil springs 23 and 24 expand, and the ink cartridge 10 is partially ejected from the cartridge mounting portion 1276. The user then grasps the rear portion of the ink cartridge 10 and removes the ink cartridge 10 from the cartridge mounting portion 1276. Thus, the ink cartridge readily may be removed from the cartridge mounting portion 1276. Moreover, because the ink cartridge 10 is not configured to retain the movable member 21 in the second position by itself, the movable member 21 moves freely from the second position to the first position when the second portion 1292 separates from the latching recess 1000, and thereby the ink cartridge 10 is partially ejected from the cartridge mounting portion 1276.

Although the present invention has been described in connection with its natural environment with respect to its intended use with a printer, those of ordinary skill in the art will understand that the claims in the present application are directed towards ink cartridges. Moreover, any description of printer components in the claims merely are describing the intended environment of the claimed ink cartridge, and do not constitute components of the claimed invention.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

a first signal blocking portion;

a second signal blocking portion;

a third signal blocking portion, wherein the first signal blocking portion is configured to either prevent a first signal from passing therethrough or to alter a path of the first signal when the first signal blocking portion receives the first signal, the second signal blocking portion is configured to either prevent a second signal from passing therethrough or to alter a path of the second signal when the second signal blocking portion receives the second signal, and the third signal blocking portion is configured to either prevent the second signal from passing therethrough or to alter a path of the second signal when the third signal blocking portion receives the second signal;

a case having at least a portion of an ink chamber defined therein, wherein the ink chamber is configured to store ink therein, and a non-signal blocking portion is formed between the second signal blocking portion and the third signal blocking portion, wherein at least a portion of the non-signal blocking portion is formed at an exterior of the ink cartridge;

an ink supply portion configured to supply the ink from an interior of the ink chamber to an exterior of the ink chamber, wherein the second signal blocking portion is positioned between the first signal blocking portion and the ink supply portion; and a translucent portion having an inner space formed therein, wherein the inner space of the translucent portion is configured to be in fluid communication with the interior of the ink chamber, and the third signal blocking portion is positioned within the inner space of the translucent portion, wherein the non-signal blocking portion extends from the second signal blocking portion to the third signal blocking portion, wherein the third signal blocking portion is configured to indicate whether a predetermined amount of ink remains in the ink chamber, and wherein the third signal blocking portion is configured to move with respect to each of the first signal blocking portion and the second signal blocking portion.

2. The ink cartridge of claim 1, wherein the first signal blocking portion and the second signal blocking portion are configured to move with respect to the third signal blocking portion.

3. The ink cartridge of claim 1, wherein the first signal blocking portion is fixed with respect to the second signal blocking portion.

4. The ink cartridge of claim 1, wherein the first signal blocking portion and the second signal blocking portion are integral.

5. The ink cartridge of claim 1, wherein the non-signal blocking portion comprises a gap which is formed at the exterior of the ink cartridge between the second signal blocking portion and the case, and is aligned with the second signal blocking portion and the case in a predetermined direction.

6. An ink cartridge, comprising:

a first signal blocking portion;

a second signal blocking portion;

a third signal blocking portion, wherein the first signal blocking portion is configured to either prevent a first signal from passing therethrough or to alter a path of the first signal when the first signal blocking portion receives the first signal, the second signal blocking portion is configured to either prevent a second signal from passing therethrough or to alter a path of the second signal when the second signal blocking portion receives the second signal, and the third signal blocking portion is configured to either prevent the second signal from passing therethrough or to alter a path of the second signal when the third signal blocking portion receives the second signal;

a case having at least a portion of an ink chamber defined therein, wherein the ink chamber is configured to store ink therein, and a non-signal blocking portion is formed between the second signal blocking portion and the third signal blocking portion, wherein at least a portion of the non-signal blocking portion is formed at an exterior of the ink cartridge;

an ink supply portion configured to supply the ink from an interior of the ink chamber to an exterior of the ink chamber, wherein the second signal blocking portion is positioned between the first signal blocking portion and the ink supply portion;

a movable member configured to move relative to the case, wherein the movable member comprises the first signal blocking portion and the second signal blocking portion; and at least one resilient member having a first end which is coupled to the case and a second end which is coupled to the movable member, wherein the third signal blocking portion is positioned within the case, wherein the non-signal blocking portion extends from the second signal blocking portion to the third signal blocking portion, and wherein the third signal blocking portion is configured to indicate whether a predetermined amount of ink remains in the ink chamber, and wherein the first signal blocking portion and the second signal blocking portion are configured to move with respect to the third signal blocking portion.

7. The ink cartridge of claim 6, wherein the at least one resilient member couples the case to the moveable member.

8. The ink cartridge of claim 7, wherein the at least one resilient member comprises a first resilient member and a second resilient member which expand and contract in the same direction as each other.

9. The ink cartridge of claim 6, wherein the third signal blocking portion is configured to move with respect to each of the first signal blocking portion and the second signal blocking portion.

10. The ink cartridge of claim 6, wherein the first signal blocking portion is fixed with respect to the second signal blocking portion.

11. The ink cartridge of claim 6, wherein the first signal blocking portion and the second signal blocking portion are integral.

12. The ink cartridge of claim 6, wherein the non-signal blocking portion comprises a gap which is formed at the exterior of the ink cartridge between the second signal blocking portion and the case, and is aligned with the second signal blocking portion and the case in a predetermined direction.

13. An ink cartridge, comprising:

a first signal blocking portion configured to selectively prevent a first signal from passing therethrough or to alter a path of the first signal;

a second signal blocking portion configured to selectively prevent a second signal from passing therethrough or to alter a path of the second signal;

a third signal blocking portion configured to selectively prevent the second signal from passing therethrough or to alter a path of the second signal, wherein the second signal blocking portion has a thickness determinative of whether the second signal blocking portion prevents the second signal from passing therethrough or alters the path of the second signal at a time that the first signal blocking portion initially prevents the first signal from passing therethrough or alters the path of the first signal; and a case having at least a portion of an ink chamber defined therein, wherein the ink chamber is configured to store ink therein, and a non-signal blocking portion is formed between the second signal blocking portion and the third signal blocking portion, wherein at least a portion of the non-signal blocking portion is formed at an exterior of the ink cartridge, wherein the non-signal blocking portion extends from the second signal blocking portion to the third signal blocking portion, wherein the third signal blocking portion is configured to indicate whether a predetermined amount of ink remains in the ink chamber, wherein the thickness of the second signal blocking portion is based on at least one characteristic associated with the ink cartridge or the ink stored in the ink cartridge, the at least one characteristic comprising at least one characteristic selected from the group consisting of a capacity of the ink chamber, an amount of ink stored in the ink chamber, a type of ink stored within the ink chamber, and a color of ink stored in the ink chamber.

14. The ink cartridge of claim 13, further comprising:

a movable member configured to move relative to the case, wherein the movable member comprises the first signal blocking portion and the second signal blocking portion; and at least one resilient member having a first end which is coupled to the case and a second end which is coupled to the movable member, wherein the third signal blocking portion is positioned within the ink chamber and is configured to move within the ink chamber based on an amount of ink in the ink chamber.

15. The ink cartridge of claim 13, wherein the first signal blocking portion and the second signal blocking portion are integral.

16. The ink cartridge of claim 13, wherein the non-signal blocking portion comprises a gap which is formed at the exterior of the ink cartridge between the second signal blocking portion and the case, and is aligned with the second signal blocking portion and the case in a predetermined direction.

* * * * *